US008941580B2

(12) United States Patent
Li et al.

(10) Patent No.: US 8,941,580 B2
(45) Date of Patent: Jan. 27, 2015

(54) LIQUID CRYSTAL DISPLAY WITH AREA ADAPTIVE BACKLIGHT

(75) Inventors: Feng Li, Rochester, NY (US); Xiao-Fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 1305 days.

(21) Appl. No.: 11/607,553

(22) Filed: Nov. 30, 2006

(65) Prior Publication Data

US 2008/0129677 A1 Jun. 5, 2008

(51) Int. Cl.
*G09G 3/36* (2006.01)
*G09G 3/34* (2006.01)

(52) U.S. Cl.
CPC ..... *G09G 3/3426* (2013.01); *G09G 3/3611* (2013.01); *G09G 2310/061* (2013.01); *G09G 2320/0238* (2013.01); *G09G 2320/0247* (2013.01); *G09G 2320/0252* (2013.01); *G09G 2320/0261* (2013.01); *G09G 2320/0271* (2013.01); *G09G 2320/0646* (2013.01); *G09G 2320/0653* (2013.01); *G09G 2320/066* (2013.01); *G09G 2320/103* (2013.01); *G09G 2330/021* (2013.01); *G09G 2340/16* (2013.01); *G09G 2360/18* (2013.01)
USPC ..... 345/102; 345/690; 345/87; 345/104; 345/204

(58) Field of Classification Search
USPC ..... 345/87, 204, 102, 690
See application file for complete search history.

(56) References Cited

U.S. PATENT DOCUMENTS

| | | | |
|---|---|---|---|
| 3,329,474 | A | 7/1967 | Harris et al. |
| 3,375,052 | A | 3/1968 | Kosanke et al. |
| 3,428,743 | A | 2/1969 | Hanlon |
| 3,439,348 | A | 4/1969 | Harris et al. |
| 3,499,700 | A | 3/1970 | Harris et al. |
| 3,503,670 | A | 3/1970 | Kosanke et al. |
| 3,554,632 | A | 1/1971 | Chitayat |
| 3,947,227 | A | 3/1976 | Granger et al. |
| 4,012,116 | A | 3/1977 | Yevick |
| 4,110,794 | A | 8/1978 | Lester et al. |
| 4,170,771 | A | 10/1979 | Bly |
| 4,187,519 | A | 2/1980 | Vitols et al. |
| 4,384,336 | A | 5/1983 | Frankle et al. |
| 4,385,806 | A | 5/1983 | Fergason |

(Continued)

FOREIGN PATENT DOCUMENTS

| | | | |
|---|---|---|---|
| EP | 0 732 669 | A1 | 9/1996 |
| EP | 0 829 747 | A1 | 3/1998 |

(Continued)

OTHER PUBLICATIONS

Youngshin Kwak and Lindsay W. MacDonald, "Accurate Prediction of Colours on Liquid Crystal Displays," Colour & Imaging Institute, University of Derby, Derby, United Kingdom, IS&T/SID Ninth Color Imaging Conference, pp. 355-359, Date Unknown.

(Continued)

*Primary Examiner* — Grant Sitta
(74) *Attorney, Agent, or Firm* — Chernoff Vilhauer McClung & Stenzel, LLP

(57) ABSTRACT

A backlight display has improved display characteristics. An image is displayed on the display which includes a liquid crystal material with a light valve. The display receives an image signal and modifies the light for a backlight array and a liquid crystal layer.

16 Claims, 14 Drawing Sheets

Iterative algorithm to derive LED driving signal

(56) References Cited

U.S. PATENT DOCUMENTS

| | | | |
|---|---|---|---|
| 4,410,238 | A | 10/1983 | Hanson |
| 4,441,791 | A | 4/1984 | Hornbeck |
| 4,516,837 | A | 5/1985 | Soref et al. |
| 4,540,243 | A | 9/1985 | Fergason |
| 4,562,433 | A | 12/1985 | Biferno |
| 4,574,364 | A | 3/1986 | Tabata et al. |
| 4,611,889 | A | 9/1986 | Buzak |
| 4,648,691 | A | 3/1987 | Oguchi et al. |
| 4,649,425 | A | 3/1987 | Pund |
| 4,682,270 | A | 7/1987 | Whitehead et al. |
| RE32,521 | E | 10/1987 | Fergason |
| 4,715,010 | A | 12/1987 | Inoue et al. |
| 4,719,507 | A | 1/1988 | Bos |
| 4,755,038 | A | 7/1988 | Baker |
| 4,758,818 | A | 7/1988 | Vatne |
| 4,766,430 | A | 8/1988 | Gillette et al. |
| 4,834,500 | A | 5/1989 | Hilsum et al. |
| 4,862,270 | A | 8/1989 | Nishio |
| 4,862,496 | A | 8/1989 | Kelly et al. |
| 4,885,783 | A | 12/1989 | Whitehead et al. |
| 4,888,690 | A | 12/1989 | Huber |
| 4,910,413 | A | 3/1990 | Tamune |
| 4,917,452 | A | 4/1990 | Liebowitz |
| 4,918,534 | A | 4/1990 | Lam et al. |
| 4,933,754 | A | 6/1990 | Reed et al. |
| 4,954,789 | A | 9/1990 | Sampsell |
| 4,958,915 | A | 9/1990 | Okada et al. |
| 4,969,717 | A | 11/1990 | Mallinson |
| 4,981,838 | A | 1/1991 | Whitehead |
| 4,991,924 | A | 2/1991 | Shankar et al. |
| 5,012,274 | A | 4/1991 | Dolgoff |
| 5,013,140 | A | 5/1991 | Healey et al. |
| 5,074,647 | A | 12/1991 | Fergason et al. |
| 5,075,789 | A | 12/1991 | Jones et al. |
| 5,083,199 | A | 1/1992 | Borner |
| 5,122,791 | A | 6/1992 | Gibbons et al. |
| 5,128,782 | A | 7/1992 | Wood |
| 5,138,449 | A | 8/1992 | Kerpchar |
| 5,144,292 | A | 9/1992 | Shiraishi et al. |
| 5,164,829 | A | 11/1992 | Wada |
| 5,168,183 | A | 12/1992 | Whitehead |
| 5,187,603 | A | 2/1993 | Bos |
| 5,202,897 | A | 4/1993 | Whitehead |
| 5,206,633 | A | 4/1993 | Zalph |
| 5,214,758 | A | 5/1993 | Ohba et al. |
| 5,222,209 | A | 6/1993 | Murata et al. |
| 5,224,178 | A | 6/1993 | Madden et al. |
| 5,247,366 | A | 9/1993 | Ginosar et al. |
| 5,256,676 | A | 10/1993 | Hider et al. |
| 5,293,258 | A | 3/1994 | Dattilo |
| 5,300,942 | A | 4/1994 | Dolgoff |
| 5,305,146 | A | 4/1994 | Nakagaki et al. |
| 5,311,217 | A | 5/1994 | Guerin et al. |
| 5,313,225 | A | 5/1994 | Miyadera |
| 5,313,454 | A | 5/1994 | Bustini et al. |
| 5,317,400 | A | 5/1994 | Gurley et al. |
| 5,337,068 | A | 8/1994 | Stewart et al. |
| 5,339,382 | A | 8/1994 | Whitehead |
| 5,357,369 | A | 10/1994 | Pilling et al. |
| 5,359,345 | A | 10/1994 | Hunter |
| 5,369,266 | A | 11/1994 | Nohda et al. |
| 5,369,432 | A | 11/1994 | Kennedy |
| 5,386,253 | A | 1/1995 | Fielding |
| 5,394,195 | A | 2/1995 | Herman |
| 5,395,755 | A | 3/1995 | Thorpe et al. |
| 5,416,496 | A | 5/1995 | Wood |
| 5,422,680 | A | 6/1995 | Lagoni et al. |
| 5,426,312 | A | 6/1995 | Whitehead |
| 5,436,755 | A | 7/1995 | Guerin |
| 5,450,498 | A | 9/1995 | Whitehead |
| 5,456,255 | A | 10/1995 | Abe et al. |
| 5,461,397 | A | 10/1995 | Zhang et al. |
| 5,471,225 | A | 11/1995 | Parks |
| 5,471,228 | A | 11/1995 | Ilcisin et al. |
| 5,477,274 | A | 12/1995 | Akiyoshi |
| 5,481,637 | A | 1/1996 | Whitehead |
| 5,537,128 | A | 7/1996 | Keene et al. |
| 5,570,210 | A | 10/1996 | Yoshida et al. |
| 5,579,134 | A | 11/1996 | Lengyel |
| 5,580,791 | A | 12/1996 | Thorpe et al. |
| 5,592,193 | A | 1/1997 | Chen |
| 5,617,112 | A | 4/1997 | Yoshida et al. |
| 5,642,015 | A | 6/1997 | Whitehead et al. |
| 5,642,128 | A | 6/1997 | Inoue |
| D381,355 | S | 7/1997 | Frank-Braun |
| 5,650,880 | A | 7/1997 | Shuter et al. |
| 5,652,672 | A | 7/1997 | Huignard et al. |
| 5,661,839 | A | 8/1997 | Whitehead |
| 5,682,075 | A | 10/1997 | Bolleman et al. |
| 5,684,354 | A | 11/1997 | Gleckman |
| 5,689,283 | A | 11/1997 | Shirochi |
| 5,715,347 | A | 2/1998 | Whitehead |
| 5,717,421 | A | 2/1998 | Katakura et al. |
| 5,717,422 | A | 2/1998 | Fergason |
| 5,729,242 | A | 3/1998 | Margerum et al. |
| 5,748,164 | A | 5/1998 | Handschy et al. |
| 5,751,264 | A | 5/1998 | Cavallerano et al. |
| 5,754,159 | A | 5/1998 | Wood et al. |
| 5,767,828 | A | 6/1998 | McKnight |
| 5,767,837 | A | 6/1998 | Hara |
| 5,774,599 | A | 6/1998 | Muka et al. |
| 5,784,181 | A | 7/1998 | Loiseaux et al. |
| 5,796,382 | A | 8/1998 | Beeteson |
| 5,809,169 | A | 9/1998 | Rezzouk et al. |
| 5,854,662 | A | 12/1998 | Yuyama et al. |
| 5,886,681 | A | 3/1999 | Walsh et al. |
| 5,889,567 | A | 3/1999 | Swanson et al. |
| 5,892,325 | A | 4/1999 | Gleckman |
| 5,901,266 | A | 5/1999 | Whitehead |
| 5,912,651 | A | 6/1999 | Bitzakidis et al. |
| 5,939,830 | A | 8/1999 | Praiswater |
| 5,940,057 | A | 8/1999 | Lien et al. |
| 5,959,777 | A | 9/1999 | Whitehead |
| 5,969,704 | A | 10/1999 | Green et al. |
| 5,978,142 | A | 11/1999 | Blackham et al. |
| 5,986,628 | A | 11/1999 | Tuenge et al. |
| 5,991,456 | A | 11/1999 | Rahman et al. |
| 5,995,070 | A | 11/1999 | Kitada |
| 5,999,307 | A | 12/1999 | Whitehead et al. |
| 6,008,929 | A | 12/1999 | Akimoto et al. |
| 6,024,462 | A | 2/2000 | Whitehead |
| 6,025,583 | A | 2/2000 | Whitehead |
| 6,043,591 | A | 3/2000 | Gleckman |
| 6,050,704 | A | 4/2000 | Park |
| 6,064,784 | A | 5/2000 | Whitehead et al. |
| 6,067,645 | A | 5/2000 | Yamamoto et al. |
| 6,079,844 | A | 6/2000 | Whitehead et al. |
| 6,111,559 | A | 8/2000 | Motomura et al. |
| 6,111,622 | A | 8/2000 | Abileah |
| 6,120,588 | A | 9/2000 | Jacobson |
| 6,120,839 | A | 9/2000 | Comiskey et al. |
| 6,129,444 | A | 10/2000 | Tognoni |
| 6,160,595 | A | 12/2000 | Kishimoto |
| 6,172,798 | B1 | 1/2001 | Albert et al. |
| 6,211,851 | B1 | 4/2001 | Lien et al. |
| 6,215,920 | B1 | 4/2001 | Whitehead et al. |
| 6,232,948 | B1 | 5/2001 | Tsuchi |
| 6,243,068 | B1 | 6/2001 | Evanicky et al. |
| 6,267,850 | B1 | 7/2001 | Bailey et al. |
| 6,268,843 | B1 | 7/2001 | Arakawa |
| 6,276,801 | B1 | 8/2001 | Fielding |
| 6,300,931 | B1 | 10/2001 | Someya et al. |
| 6,300,932 | B1 | 10/2001 | Albert |
| 6,304,365 | B1 | 10/2001 | Whitehead |
| 6,323,455 | B1 | 11/2001 | Bailey et al. |
| 6,323,989 | B1 | 11/2001 | Jacobson et al. |
| 6,327,072 | B1 | 12/2001 | Comiskey et al. |
| RE37,594 | E | 3/2002 | Whitehead |
| 6,359,662 | B1 | 3/2002 | Walker |
| 6,377,383 | B1 | 4/2002 | Whitehead et al. |
| 6,384,979 | B1 | 5/2002 | Whitehead et al. |
| 6,400,436 | B1 | 6/2002 | Komatsu |
| 6,414,664 | B1 | 7/2002 | Conover et al. |
| 6,418,253 | B2 | 7/2002 | Whitehead |

(56) References Cited

U.S. PATENT DOCUMENTS 6,424,369 B1 7/2002 Adair et al.
6,428,189 B1 8/2002 Hochstein
6,435,654 B1 8/2002 Wang et al.
6,437,921 B1 8/2002 Whitehead
6,439,731 B1 8/2002 Johnson et al.
6,448,944 B2 9/2002 Ronzani et al.
6,448,951 B1 9/2002 Sakaguchi et al.
6,448,955 B1 9/2002 Evanicky et al.
6,452,734 B1 9/2002 Whitehead et al.
6,483,643 B1 11/2002 Zuchowski
6,507,327 B1 1/2003 Atherton et al.
6,545,677 B2 4/2003 Brown
6,559,827 B1 5/2003 Mangerson
6,573,928 B1 6/2003 Jones et al.
6,574,025 B2 6/2003 Whitehead et al.
6,590,561 B1 7/2003 Kabel et al.
6,597,339 B1 7/2003 Ogawa
6,608,614 B1 8/2003 Johnson
6,624,828 B1 9/2003 Dresevic et al.
6,657,607 B1 12/2003 Evanicky et al.
6,680,834 B2 1/2004 Williams
6,690,383 B1 2/2004 Braudaway et al.
6,697,110 B1 2/2004 Jaspers et al.
6,700,559 B1 3/2004 Tanaka et al.
6,753,876 B2 6/2004 Brooksby et al.
6,766,068 B2 7/2004 Aoyama et al.
6,788,280 B2 9/2004 Ham
6,791,520 B2 9/2004 Choi
6,803,901 B1 10/2004 Numao
6,816,141 B1 11/2004 Fergason
6,816,142 B2 11/2004 Oda et al.
6,816,262 B1 11/2004 Slocum et al.
6,828,816 B2 12/2004 Ham
6,834,125 B2 12/2004 Woodell et al.
6,846,098 B2 1/2005 Bourdelais et al.
6,856,449 B2 2/2005 Winkler et al.
6,862,012 B1 3/2005 Funakoshi et al.
6,864,916 B1 3/2005 Nayar et al.
6,885,369 B2 4/2005 Tanahashi et al.
6,891,672 B2 5/2005 Whitehead et al.
6,900,796 B2 5/2005 Yasunishi et al.
6,932,477 B2 8/2005 Stanton
6,954,193 B1 10/2005 Andrade et al.
6,975,369 B1 12/2005 Burkholder
7,002,546 B1 2/2006 Stuppi et al.
7,113,163 B2 9/2006 Nitta et al.
7,113,164 B1 9/2006 Kurihara
7,123,222 B2 10/2006 Borel et al.
7,154,468 B2 * 12/2006 Linzmeier et al. ..... 345/102
7,161,577 B2 1/2007 Hirakata et al.
7,567,245 B2 * 7/2009 Mamata ..... 345/207
8,026,894 B2 * 9/2011 Feng ..... 345/102
2001/0005192 A1 6/2001 Walton et al.
2001/0013854 A1 8/2001 Ogoro
2001/0024199 A1 9/2001 Hughes et al.
2001/0035853 A1 11/2001 Hoelen et al.
2001/0038736 A1 11/2001 Whitehead
2001/0048407 A1 12/2001 Yasunishi et al.
2001/0052897 A1 12/2001 Nakano et al.
2002/0003520 A1 1/2002 Aoki
2002/0003522 A1 1/2002 Baba et al.
2002/0008694 A1 1/2002 Miyachi et al.
2002/0033783 A1 3/2002 Koyama
2002/0036650 A1 3/2002 Kasahara et al.
2002/0044116 A1 4/2002 Tagawa et al.
2002/0057238 A1 5/2002 Nitta et al.
2002/0057253 A1 5/2002 Lim et al.
2002/0063963 A1 5/2002 Whitehead et al.
2002/0067325 A1 6/2002 Choi
2002/0067332 A1 6/2002 Hirakata et al.
2002/0070914 A1 6/2002 Bruning et al.
2002/0093521 A1 7/2002 Daly et al.
2002/0105709 A1 8/2002 Whitehead et al.
2002/0135553 A1 9/2002 Nagai et al.
2002/0149574 A1 10/2002 Johnson et al.
2002/0149575 A1 10/2002 Moon
2002/0154088 A1 10/2002 Nishimura
2002/0159002 A1 10/2002 Chang
2002/0159692 A1 10/2002 Whitehead
2002/0162256 A1 11/2002 Wardle et al.
2002/0171617 A1 11/2002 Fuller
2002/0175907 A1 11/2002 Sekiya et al.
2002/0180733 A1 12/2002 Colmenarez et al.
2002/0190940 A1 12/2002 Itoh et al.
2003/0012448 A1 1/2003 Kimmel et al.
2003/0026494 A1 2/2003 Woodell et al.
2003/0043394 A1 3/2003 Kuwata et al.
2003/0048393 A1 3/2003 Sayag
2003/0053689 A1 3/2003 Watanabe et al.
2003/0072496 A1 4/2003 Woodell et al.
2003/0090455 A1 5/2003 Daly
2003/0107538 A1 6/2003 Asao et al.
2003/0108245 A1 6/2003 Gallagher et al.
2003/0112391 A1 6/2003 Jang et al.
2003/0128337 A1 7/2003 Jaynes et al.
2003/0132905 A1 7/2003 Lee et al.
2003/0142118 A1 7/2003 Funamoto et al.
2003/0169247 A1 * 9/2003 Kawabe et al. ..... 345/204
2003/0174262 A1 9/2003 Sugawara
2003/0179221 A1 9/2003 Nitta et al.
2003/0197674 A1 * 10/2003 Herrmann ..... 345/102
2003/0197709 A1 10/2003 Shimazaki et al.
2004/0012551 A1 1/2004 Ishii
2004/0041782 A1 3/2004 Tachibana
2004/0051724 A1 3/2004 Elliott et al.
2004/0057017 A1 3/2004 Childers et al.
2004/0201561 A1 10/2004 Funamoto
2004/0239587 A1 12/2004 Murata et al.
2004/0263450 A1 12/2004 Lee et al.
2005/0073495 A1 4/2005 Harbers et al.
2005/0088403 A1 4/2005 Yamazaki
2005/0157298 A1 7/2005 Evanicky et al.
2005/0190164 A1 9/2005 Velthoven et al.
2005/0200295 A1 9/2005 Lim et al.
2005/0225561 A1 10/2005 Higgins et al.
2005/0225574 A1 10/2005 Brown et al.
2005/0248553 A1 * 11/2005 Feng et al. ..... 345/204
2005/0248593 A1 11/2005 Feng et al.
2005/0259064 A1 11/2005 Sugino et al.
2006/0071936 A1 4/2006 Leyvi et al.
2006/0104508 A1 5/2006 Daly et al.
2006/0120598 A1 6/2006 Takahashi et al.
2006/0146003 A1 * 7/2006 Diefenbaugh et al. ..... 345/102
2006/0208998 A1 9/2006 Okishiro et al.
2006/0221047 A1 * 10/2006 Tanizoe et al. ..... 345/102
2006/0262078 A1 * 11/2006 Inuzuka et al. ..... 345/102
2006/0262111 A1 11/2006 Kerofsky
2007/0052636 A1 3/2007 Kalt et al.
2008/0025634 A1 1/2008 Border et al.
2008/0088560 A1 4/2008 Bae et al.

FOREIGN PATENT DOCUMENTS

EP 0 606 162 B1 11/1998
EP 0912047 4/1999
EP 0 963 112 A1 12/1999
EP 1168243 1/2002
EP 1 202 244 A1 5/2002
EP 1 206 130 A1 5/2002
EP 1 313 066 A1 5/2003
EP 1 316 919 A2 6/2003
EP 1 453 002 9/2004
EP 1 453 030 A1 9/2004
FR 2 611 389 2/1987
GB 2 388 737 11/2003
JP 64-10299 1/1989
JP 1-98383 4/1989
JP 3-71111 3/1991
JP 3-198026 8/1991
JP 5-66501 3/1993
JP 5-80716 4/1993
JP 5-273523 10/1993
JP 5-289044 11/1993
JP 6-247623 9/1994

(56) References Cited

FOREIGN PATENT DOCUMENTS

| | | | |
|---|---|---|---|
| JP | 6-313018 | | 11/1994 |
| JP | 7-121120 | | 5/1995 |
| JP | 9-244548 | | 9/1997 |
| JP | 10-508120 | | 8/1998 |
| JP | 11-052412 | | 2/1999 |
| JP | 2002-099250 | | 4/2000 |
| JP | 2000-206488 | | 7/2000 |
| JP | 2000-275995 | | 10/2000 |
| JP | 2000-321571 | | 11/2000 |
| JP | 2001-142409 | | 5/2001 |
| JP | 2002-091385 | | 3/2002 |
| JP | 2002-099250 | A | 4/2002 |
| JP | 2003-204450 | | 7/2003 |
| JP | 2003-230010 | | 8/2003 |
| JP | 3523170 | | 2/2004 |
| JP | 2004-294540 | | 10/2004 |
| JP | 2005-241677 | A | 9/2005 |
| JP | 2005-309338 | A | 11/2005 |
| KR | 10-2004-0084777 | | 10/2004 |
| TW | 406206 | | 9/2000 |
| WO | WO 91/15843 | | 10/1991 |
| WO | WO 93/20660 | | 10/1993 |
| WO | WO 96/33483 | | 10/1996 |
| WO | WO 98/08134 | | 2/1998 |
| WO | WO 00/75720 | | 12/2000 |
| WO | WO 01/69584 | | 9/2001 |
| WO | WO 02/03687 | | 1/2002 |
| WO | WO 02/079862 | | 10/2002 |
| WO | WO 03/077013 | | 9/2003 |
| WO | WO 2004/013835 | | 2/2004 |

OTHER PUBLICATIONS

Fumiaki Yamada and Yoichi Taira, "An LED backlight for color LCD," IBM Research, Tokyo Research Laboratory, 1623-14, Shimotsuruma, Yamato, Kanagawa-ken 242-8502, Japan, IDW'00, pp. 363-366.

A.A.S. Sluyterman and E.P. Boonekamp, "18.2: Architectural Choices in a Scanning Backlight for Large LCD TVs," Philips Lighting, Bld. HBX-p, PO Box 80020, 5600 JM Eindhoven, The Netherlands, SID 05 Digest, pp. 996-999.

Fumiaki Yamada, Hajime Nakamura, Yoshitami Sakaguchi, and Yoichi Taira,"52.2: Invited Paper: Color Sequential LCD Based on OCB with an LED Backlight," Tokyo Research Laboratory, IBM Research, Yamato, Kanagawa, Japan, SID 00 Digest, pp. 1180-1183.

Ngai-Man Cheung, et al., "Configurable entropy coding scheme for H.26L," ITU-Telecommunications Standardization Sector, Study Group 16 Question 6 Video Coding Experts Group (VCEG), Twelfth Meeting: Eibsee, Germany, Jan. 9-12, 2001, pp. 1-11.

T. Funamoto, T. Kobayashi, T. Murao, "High-Picture-Quality Technique for LCD televisions: LCD-AI," AVC Products Development Center, Matsushita Electric Industrial, Co., Ltd., 1-1 Matsushita-cho, Ibaraki, Osaka 567-0026 Japan, 2 pages, date unknown.

Steven L. Wright, et al., "Measurement and Digital compensation of Crosstalk and Photoleakage in High-Resolution TFTLCDs," IBM T.J. Watson Research Center, PO Box 218 MS 10-212, Yorktown Heights, NY 10598, pp. 1-12, date unknown.

Paul E. Debevec and Jitendra Malik, "Recovering High Dynamic Range Radiance Maps from Photographs," Proceedings of SIGGRAPH 97, Computer Graphics Proceedings, Annual Conference Series, pp. 369-378 (Aug. 1997, Los Angeles, California). Addison Wesley, Edited by Turner Whitted. ISBN 0-89791-896-7.

Dicarlo, J.M. and Wandell, B. (2000), "Rendering high dynamic range images," in Proc. IS&T/SPIE Electronic Imaging 2000. Image Sensors, vol. 3965, San Jose, CA, pp. 392-401.

Kuang, J., Yamaguchi, H., Johnson, G.M. and Fairchild, M.D. (2004), "Testing HDR image rendering algorithms (Abstract)," in Proc. IS&T/SID Twelfth Color Imaging Conference: Color Science, Systems, and Application, Scottsdale, AR, pp. 315-320.

Durand, F. and Dorsey, J. (2002), "Fast bilateral filtering for the display of high dynamic-range images," in Proc. ACM SIGGRAPH 2002, Annual Conference on Computer Graphics, San Antonia, CA, pp. 257-266.

Kang, S.B., Uyttendaele, M., Winder, S. and Szeliski, R. (2003), "High Dynamic Range Video," ACM Transactions on Graphics 22(3), 319-325.

State Intellectual Property Office of People's Republic of China, English Translation of First Office Action in Chinese Application No. 200710196106.3, Oct. 16, 2009, pp. 1-6.

Brian A. Wandell and Louis D. Silverstein, "The Science of Color," 2003, Elsevier Ltd, Ch. 8 Digital Color Reproduction, pp. 281-316.

European Search Report, Application No. EP 07 02 3070, search completed Jan. 12, 2010.

Anandan, M., "LED Backlight: Enhancement of Picture Quality on LCD Screen", Proc. of ASID '06, (Oct. 12, 2008), pp. 130-134.

Chen, H.F., et al., "Backlight Local Dimming Algorithm for High Contrast LCD-TV", Proc. of ASID '06, (Oct. 12, 2008), pp. 168-171.

Raman, N. and Hekstra, G., "Dynamic Contrast Enhancement of Liquid Crystal Displays with Backlight Modulation", IEEE, (2005, month unavailable), pp. 197-198.

Seetzen, H., et al., "High Dynamic Range Display Systems", ACM SIGGRAPH conference proceedings, pp. 1-9, (date unavailable).

Shiga. T. and Mikoshiba, S., "Reduction of LCTV Backlight Power and Enhancement of Gray Scale Capability by Using an Adaptive Dimming Technique", SID 03 Digest, (2003, month unavailable), pp. 1364-1367.

Translation of Japanese Office Action in co-pending Japanese Patent App. No. 2007-302290, dated Nov. 16, 2010, 5 pgs.

Office Action in Japanese App. No. 2007-302290, Sharp Kabushiki Kaisha, dated Jul. 5, 2011, 6 pgs., including English translation.

European Office Action, App. No. 07 023 070.1, Sharp Kabushiki Kaisha, mailed Sep. 4, 2013, 5 pgs.

* cited by examiner

LCD system configuration

Flashing backlight scheme to reduce the motion blur

The one-frame buffer non-recursive overdrive model

Motion adaptive black data insertion

Exemplary LUT for field driving value based on motion map values

Flow chart of deriving LED and LCD driving values for HDR display

LED PSF (The back box shows the LED grid)

Iterative algorithm to derive LED driving signal

LED inverse gamma correction

LCD inverse gamma correction

LIQUID CRYSTAL DISPLAY WITH AREA ADAPTIVE BACKLIGHT

CROSS-REFERENCE TO RELATED APPLICATIONS

None

BACKGROUND OF THE INVENTION

The present invention relates to backlit displays and, more particularly, to a backlit display with improved performance characteristics.

The local transmittance of a liquid crystal display (LCD) panel or a liquid crystal on silicon (LCOS) display can be varied to modulate the intensity of light passing from a backlit source through an area of the panel to produce a pixel that can be displayed at a variable intensity. Whether light from the source passes through the panel to a viewer or is blocked is determined by the orientations of molecules of liquid crystals in a light valve.

Since liquid crystals do not emit light, a visible display requires an external light source. Small and inexpensive LCD panels often rely on light that is reflected back toward the viewer after passing through the panel. Since the panel is not completely transparent, a substantial part of the light is absorbed during its transit of the panel and images displayed on this type of panel may be difficult to see except under the best lighting conditions. On the other hand, LCD panels used for computer displays and video screens are typically backlit with fluorescent tubes or arrays of light-emitting diodes (LEDs) that are built into the sides or back of the panel. To provide a display with a more uniform light level, light from these points or line sources is typically dispersed in a diffuser panel before impinging on the light valve that controls transmission to a viewer.

The transmittance of the light valve is controlled by a layer of liquid crystals interposed between a pair of polarizers. Light from the source impinging on the first polarizer comprises electromagnetic waves vibrating in a plurality of planes. Only that portion of the light vibrating in the plane of the optical axis of a polarizer can pass through the polarizer. In an LCD, the optical axes of the first and second polarizers are arranged at an angle so that light passing through the first polarizer would normally be blocked from passing through the second polarizer in the series. However, a layer of the physical orientation of the molecules of liquid crystal can be controlled and the plane of vibration of light transiting the columns of molecules spanning the layer can be rotated to either align or not align with the optical axes of the polarizers. It is to be understood that normally white may likewise be used.

The surfaces of the first and second polarizers forming the walls of the cell gap are grooved so that the molecules of liquid crystal immediately adjacent to the cell gap walls will align with the grooves and, thereby, be aligned with the optical axis of the respective polarizer. Molecular forces cause adjacent liquid crystal molecules to attempt to align with their neighbors with the result that the orientation of the molecules in the column spanning the cell gap twist over the length of the column. Likewise, the plane of vibration of light transiting the column of molecules will be Atwisted@ from the optical axis of the first polarizer to that of the second polarizer. With the liquid crystals in this orientation, light from the source can pass through the series polarizers of the translucent panel assembly to produce a lighted area of the display surface when viewed from the front of the panel. It is to be understood that the grooves may be omitted in some configurations.

To darken a pixel and create an image, a voltage, typically controlled by a thin-film transistor, is applied to an electrode in an array of electrodes deposited on one wall of the cell gap. The liquid crystal molecules adjacent to the electrode are attracted by the field created by the voltage and rotate to align with the field. As the molecules of liquid crystal are rotated by the electric field, the column of crystals is "untwisted," and the optical axes of the crystals adjacent the cell wall are rotated out of alignment with the optical axis of the corresponding polarizer progressively reducing the local transmittance of the light valve and the intensity of the corresponding display pixel. Color LCD displays are created by varying the intensity of transmitted light for each of a plurality of primary color elements (typically, red, green, and blue) that make up a display pixel.

LCDs can produce bright, high resolution, color images and are thinner, lighter, and draw less power than cathode ray tubes (CRTs). As a result, LCD usage is pervasive for the displays of portable computers, digital clocks and watches, appliances, audio and video equipment, and other electronic devices. On the other hand, the use of LCDs in certain "high end markets," such as video and graphic arts, is frustrated, in part, by the limited performance of the display.

What is desired, therefore, is a liquid crystal display having reduced blur.

DETAILED DESCRIPTION OF PREFERRED EMBODIMENT

Figure 1A:
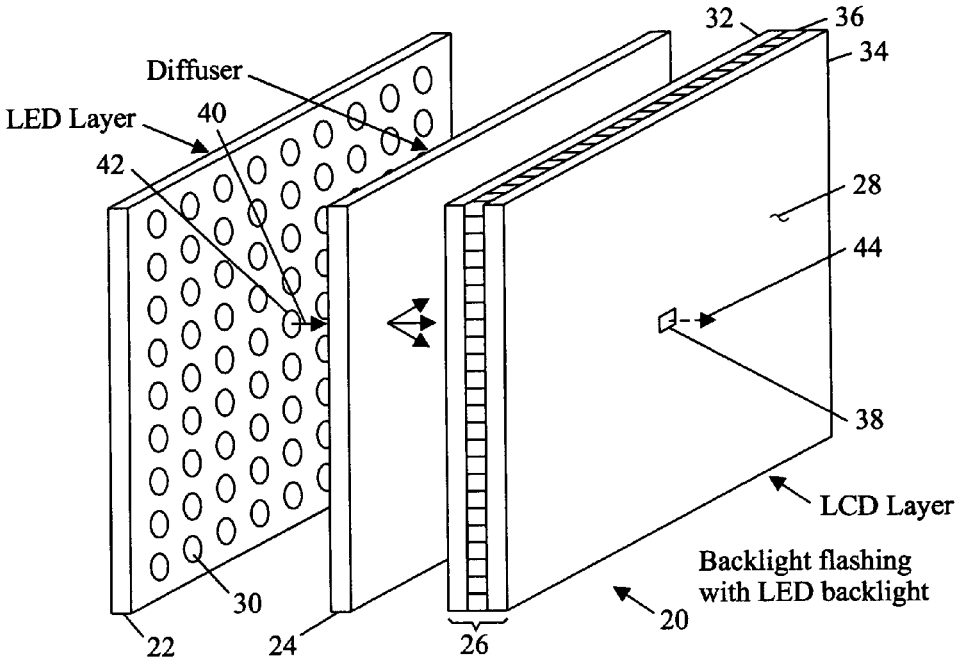
FIGS. 1A and 1B are schematic diagrams of liquid crystal displays (LCDs).
Figure 1B:
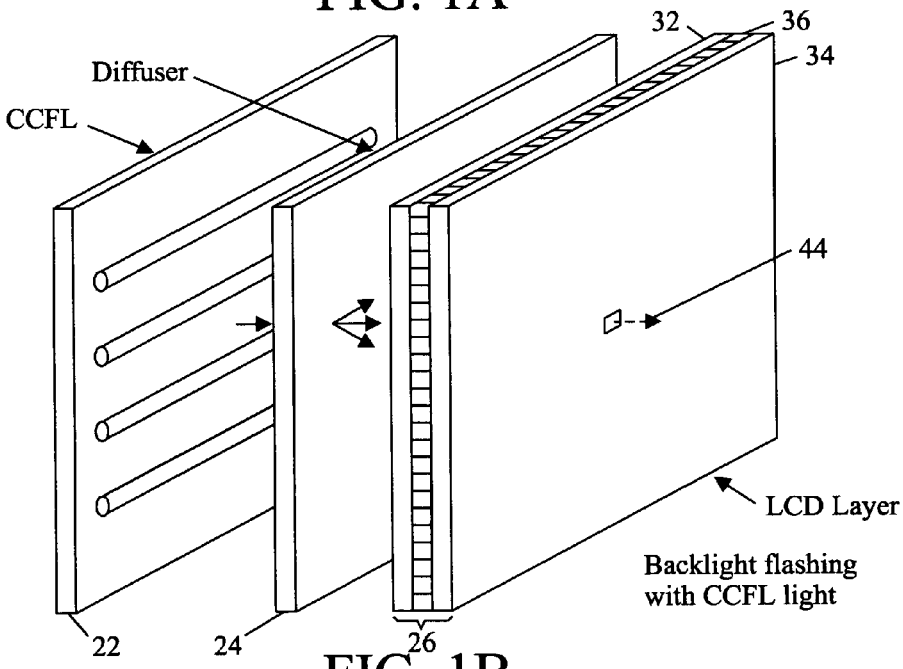

Referring to FIG. 1A, a backlit display 20 comprises, generally, a backlight 22, a diffuser 24, and a light valve 26 (indicated by a bracket) that controls the transmittance of light from the backlight 22 to a user viewing an image displayed at the front of the panel 28. The light valve, typically comprising a liquid crystal apparatus, is arranged to electronically control the transmittance of light for a picture element or pixel. Since liquid crystals do not emit light, an external source of light is necessary to create a visible image. The source of light for small and inexpensive LCDs, such as those used in digital clocks or calculators, may be light that is reflected from the back surface of the panel after passing through the panel. Likewise, liquid crystal on silicon (LCOS) devices rely on light reflected from a backplane of the light valve to illuminate a display pixel. However, LCDs absorb a significant portion of the light passing through the assembly and an artificial source of light such as the backlight 22 comprising fluorescent light tubes or an array of light sources 30 (e.g., light-emitting diodes (LEDs), as illustrated in FIG. 1A and fluorescent tubes as illustrated in FIG. 1B), are useful to produce pixels of sufficient intensity for highly visible images or to illuminate the display in poor lighting conditions. There may not be a light source 30 for each pixel of the display and, therefore, the light from the general point sources (e.g., LEDS) or general line sources (e.g., fluorescent tubes) is typically dispersed by a diffuser panel 24 so that the lighting of the front surface of the panel 28 is more uniform.

Light radiating from the light sources 30 of the backlight 22 comprises electromagnetic waves vibrating in random planes. Only those light waves vibrating in the plane of a polarizer=s optical axis can pass through the polarizer. The light valve 26 includes a first polarizer 32 and a second polarizer 34 having optical axes arrayed at an angle so that normally light cannot pass through the series of polarizers. Images are displayable with an LCD because local regions of a liquid crystal layer 36 interposed between the first 32 and second 34 polarizer can be electrically controlled to alter the alignment of the plane of vibration of light relative of the optical axis of a polarizer and, thereby, modulate the transmittance of local regions of the panel corresponding to individual pixels 36 in an array of display pixels.

The layer of liquid crystal molecules 36 occupies a cell gap having walls formed by surfaces of the first 32 and second 34 polarizers. The walls of the cell gap are rubbed to create microscopic grooves aligned with the optical axis of the corresponding polarizer. The grooves cause the layer of liquid crystal molecules adjacent to the walls of the cell gap to align with the optical axis of the associated polarizer. As a result of molecular forces, each successive molecule in the column of molecules spanning the cell gap will attempt to align with its neighbors. The result is a layer of liquid crystals comprising innumerable twisted columns of liquid crystal molecules that bridge the cell gap. As light 40 originating at a light source element 42 and passing through the first polarizer 32 passes through each translucent molecule of a column of liquid crystals, its plane of vibration is Atwisted@ so that when the light reaches the far side of the cell gap its plane of vibration will be aligned with the optical axis of the second polarizer 34. The light 44 vibrating in the plane of the optical axis of the second polarizer 34 can pass through the second polarizer to produce a lighted pixel 28 at the front surface of the display 28.

To darken the pixel 28, a voltage is applied to a spatially corresponding electrode of a rectangular array of transparent electrodes deposited on a wall of the cell gap. The resulting electric field causes molecules of the liquid crystal adjacent to the electrode to rotate toward alignment with the field. The effect is to Auntwist@ the column of molecules so that the plane of vibration of the light is progressively rotated away from the optical axis of the polarizer as the field strength increases and the local transmittance of the light valve 26 is reduced. As the transmittance of the light valve 26 is reduced, the pixel 28 progressively darkens until the maximum extinction of light 40 from the light source 42 is obtained. Color LCD displays are created by varying the intensity of transmitted light for each of a plurality of primary color elements (typically, red, green, and blue) elements making up a display pixel. Other arrangements of structures may likewise be used.

The LCD uses transistors as a select switch for each pixel, and adopts a display method (hereinafter, called as a "hold-type display"), in which a displayed image is held for a frame period. In contrast, a CRT (hereinafter, called as an "impulse-type display") includes selected pixel that is darkened immediately after the selection of the pixel. The darkened pixel is displayed between each frame of a motion image that is rewritten in 60 Hz in case of the impulse-type display like the CRT. That is, the black of the darkened pixel is displayed excluding a period when the image is displayed, and one frame of the motion image is presented respectively to the viewer as an independent image. Therefore, the image is observed as a clear motion image in the impulse-type display. Thus, the LCD is fundamentally different from CRT in time axis hold characteristic in an image display. Therefore, when the motion image is displayed on a LCD, image deterioration such as blurring the image is caused. The principal cause of this blurring effect arises from a viewer that follows the moving object of the motion image (when the eyeball movement of the viewer is a following motion), even if the image is rewritten, for example, at 60 Hz discrete steps. The eyeball has a characteristic to attempt to smoothly follow the moving object even though it is discretely presented in a "hold type" manner.

In the hold-type display, the displayed image of one frame of the motion image is held for one frame period, and is presented to the viewer during the corresponding period as a still image. Therefore, even though the eyeball of the viewer smoothly follows the moving object, the displayed image stands still for one frame period. Therefore, the shifted image is presented according to the speed of the moving object on the retina of the viewer. Accordingly, the image will appear blurred to the viewer due to integration by the eye. In addition, since the change between the images presented on the retina of the viewer increases with greater speed, such images become even more blurred.

Figure 2:
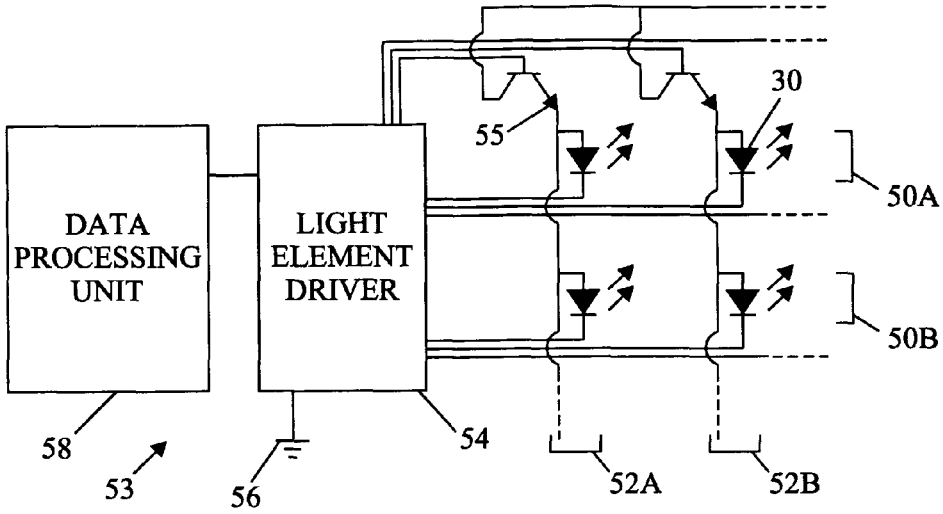
FIG. 2 is a schematic diagram of an exemplary driver for modulating the illumination of a plurality of light source elements of a backlight.

In the backlit display 20, the backlight 22 comprises an array of locally controllable light sources 30. The individual light sources 30 of the backlight may be light-emitting diodes (LEDs), an arrangement of phosphors and lensets, or other suitable light-emitting devices. In addition, the backlight may include a set of independently controllable light sources, such as one or more cold cathode ray tubes. The light-emitting diodes may be 'white' and/or separate colored light emitting diodes. The individual light sources 30 of the backlight array 22 are independently controllable to output light at a luminance level independent of the luminance level of light output by the other light sources so that a light source can be modulated in response to any suitable signal. Similarly, a film or material may be overlaid on the backlight to achieve the spatial and/or temporal light modulation. Referring to FIG. 2, the light sources 30 (LEDs illustrated) of the array 22 are typically arranged in the rows, for examples, rows 50*a* and 50*b*, (indicated by brackets) and columns, for examples, columns 52*a* and 52*b* (indicated by brackets) of a rectangular array. The output of the light sources 30 of the backlight are controlled by a backlight driver 53. The light sources 30 are driven by a light source driver 54 that powers the elements by selecting a column of elements 52*a* or 52*b* by actuating a column selection transistor 55 and connecting a selected light source 30 of the selected column to ground 56. A data processing unit 58, processing the digital values for pixels of an image to be displayed, provides a signal to the light driver 54 to select the appropriate light source 30 corresponding to the displayed pixel and to drive the light source with a power level to produce an appropriate level of illumination of the light source.

Figure 3:
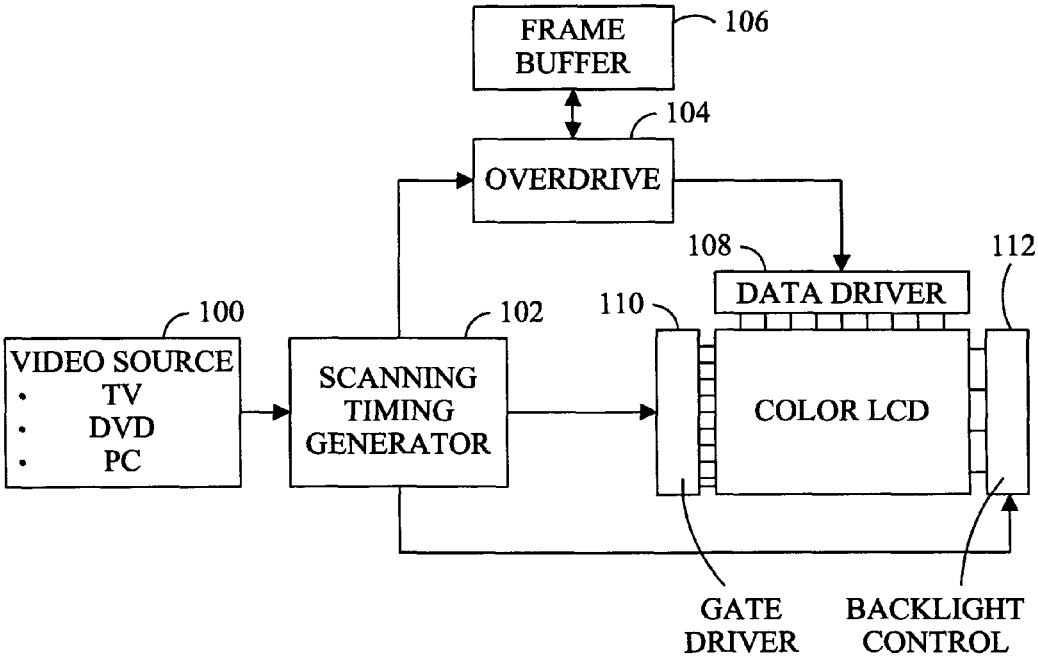
FIG. 3 illustrates an exemplary LCD system configuration.

FIG. 3 illustrates a block diagram of a typical data path within a liquid crystal panel. The video data 100 may be provided from any suitable source, such as for example, television broadcast, Internet connection, file server, digital video disc, computer, video on demand, or broadcast. The video data 100 is provided to a scanning and timing generator 102 where the video data is converted to a suitable format for presentation on the display. In many cases, each line of data is provided to an overdrive circuit 104, in combination with a frame buffer 106, to compensate for the slow temporal response of the display. The overdrive may be analog in nature, if desired. The signal from the overdrive 104 is preferably converted to a voltage value in the data driver 108 which is output to individual data electrodes of the display. The generator 102 also provides a clock signal to the gate driver 110, thereby selecting one row at a time, which stores the voltage data on the data electrode on the storage capacitor of each pixel of the display. The generator 102 also provides backlight control signals 112 to control the level of luminance from the backlight, and/or the color or color balance of the light provided in the case of spatially non-uniform backlight (e.g., based upon image content and/or spatially different in different regions of the display).

Figure 4A:
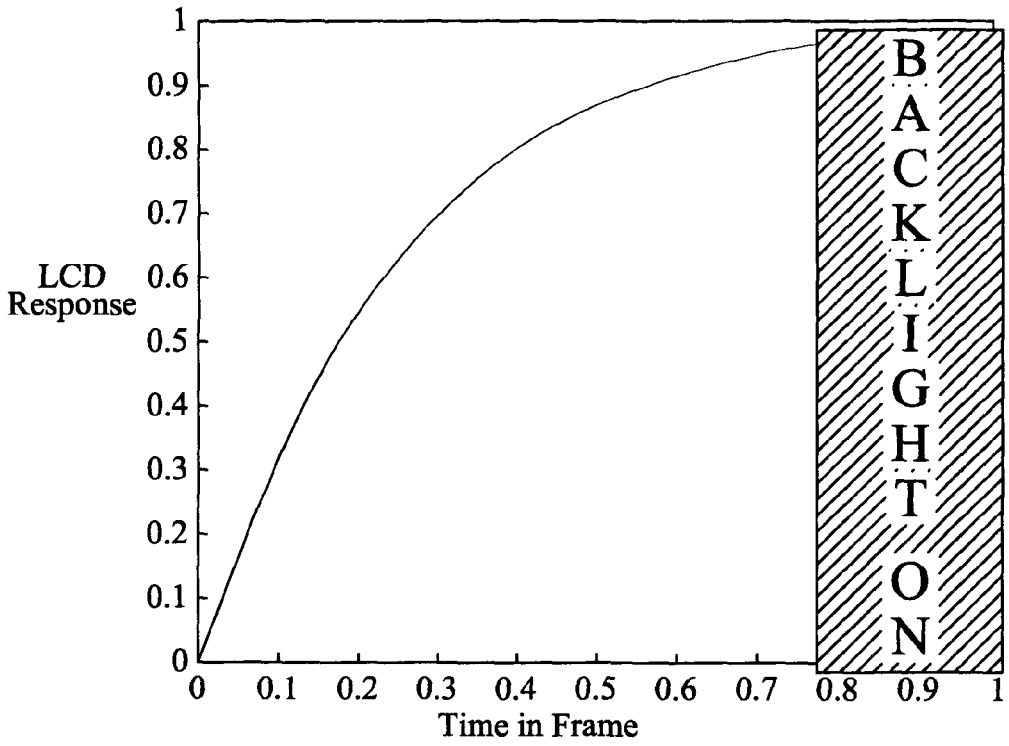
FIG. 4A illustrates an exemplary flashing backlight scheme.

The use of the overdrive circuit 104 tends to reduce the motion blur, but the image blur effects of eye tracking the motion while the image is held stationary during the frame time still causes a relative motion on the retina which is perceived as motion blur. One technique to reduce the perceived motion blur is to reduce the time that an image frame is displayed. FIG. 4A illustrates the effect of flashing the backlight during only a portion of the frame. The horizontal axis represents the elapsed time during a frame and the vertical axis represents a normalized response of the LCD during the frame. The backlight level is preferably set to zero during a portion of the frame or otherwise a significantly reduced level. It is preferable that the flashing of the backlight is toward the end of the frame where the transmission of the liquid crystal material has reached or otherwise is approaching the target level. For example, the majority of the duration of the flashing backlight is preferably during the last third of the frame period. While modulating the backlight in some manner reduces the perceived motion blur and it may be further reduced by being flashed at a higher rate.

Figure 4B:
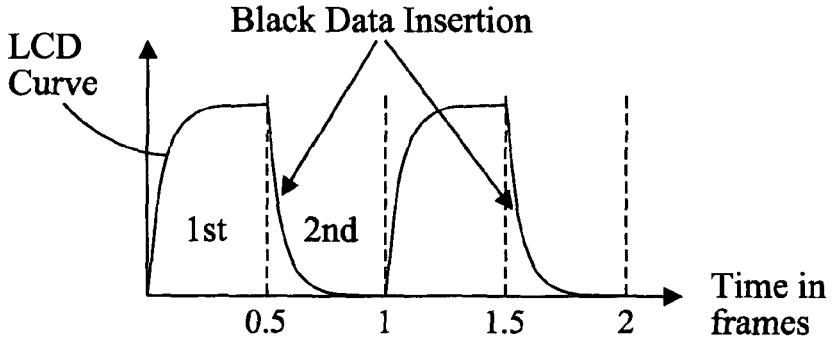
FIG. 4B illustrates an exemplary

FIG. 4B illustrates a black data insertion technique that reduces the display temporal aperture thus reducing motion blur. Each frame is divided into two fields where the first field contains the display data and the second field is driven to black. Accordingly, the display is "on" for only about half of the frame.

Figure 5:
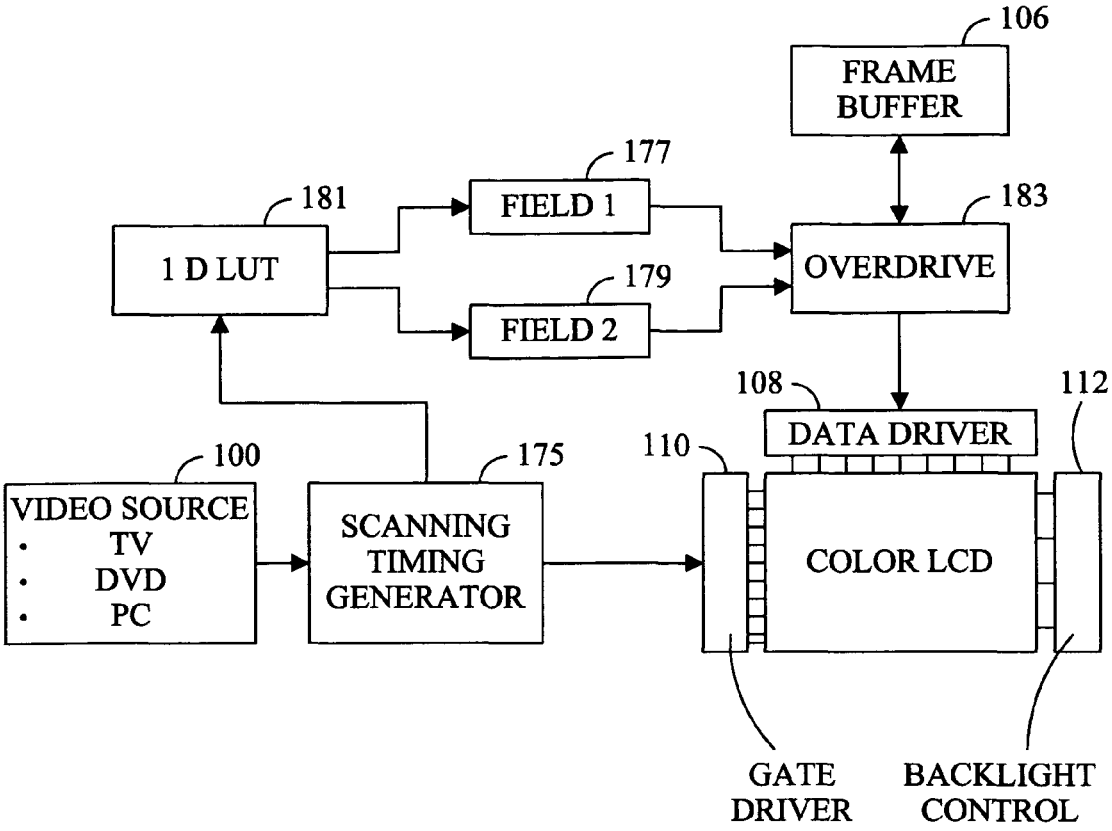
FIG. 5 illustrates an adaptive black data insertion technique.
Figure 6A:
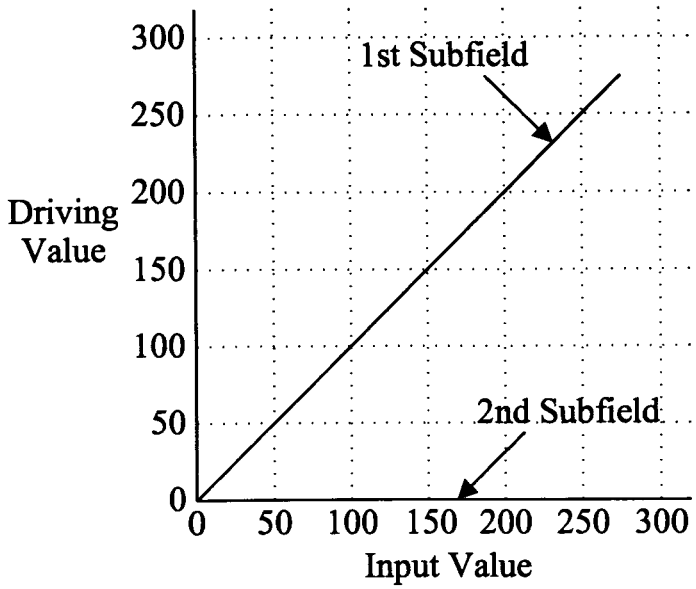
FIGS. 6A and 6B illustrate transfer field functions.
Figure 6B:
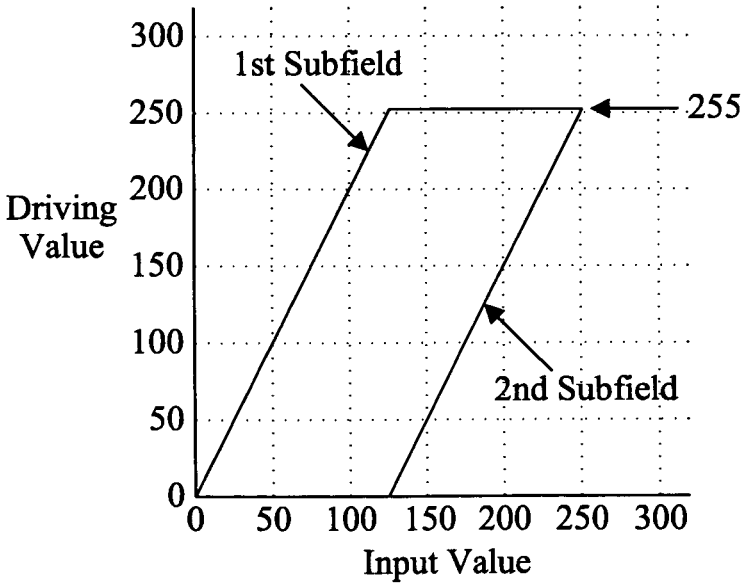

Referring to FIG. 5, the input frame 100 is provided to a scanning timing generator 175. The scanning timing generator 175 converts the input frame into two fields 177 and 179 using a look up table 181, such as a one dimensional look up table. The two fields 177 and 179 are then provided to an overdrive 183. Referring to FIG. 6, the look up table 181 may take the form of a pair of functions. As shown in FIG. 6A, the first field 177 is set to the same as the input, while the second field 179 is set to zero (e.g., black). The embodiment shown in FIG. 6A achieves a significant black point insertion into the image. This technique results in significant brightness reduction and has blurring at high luminance. As shown in FIG. 6B, the first field 177 may be set to twice of the input data until it reaches a desired level, such as the maximum (e.g., 255), and then the second subfield starts to increase from a low value, such as zero, to a desired level, such as the maximum (e.g., 255). The technique shown in FIG. 6B increases the brightness over that shown in FIG. 6A, while moderating the motion blur that may occur at a high luminance.

Figure 7:
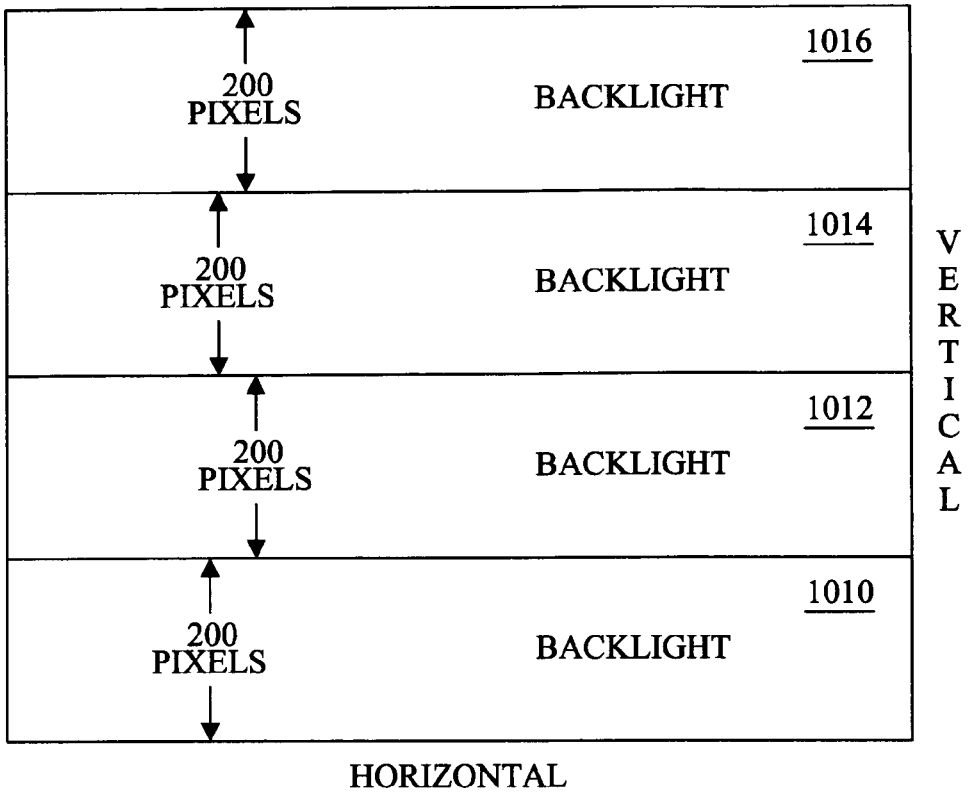
FIG. 7 illustrates an exemplary segmented backlight.

Referring to FIG. 7, illustrating a rectangular backlight structure of the display, the backlight may be structured with a plurality of different regions. For example, the backlight may be approximately 200 pixels (e.g., 50-400 pixel regions) wide and extend the width of the display. For a display with approximately 800 pixels, the backlight may be composed of, for example, 4 different backlight regions. In other embodiments, such as an array of light emitting diodes, the backlight may be composed of one or more rows of diodes, and/or one or more columns of diodes, and/or different areas in general.

Figure 8:
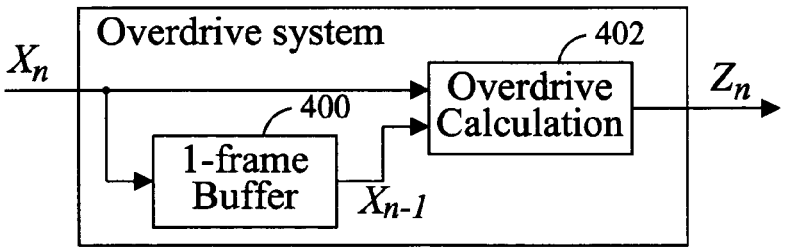
FIG. 8 illustrates an exemplary prior-art one-frame buffer overdrive.
Figure 9:
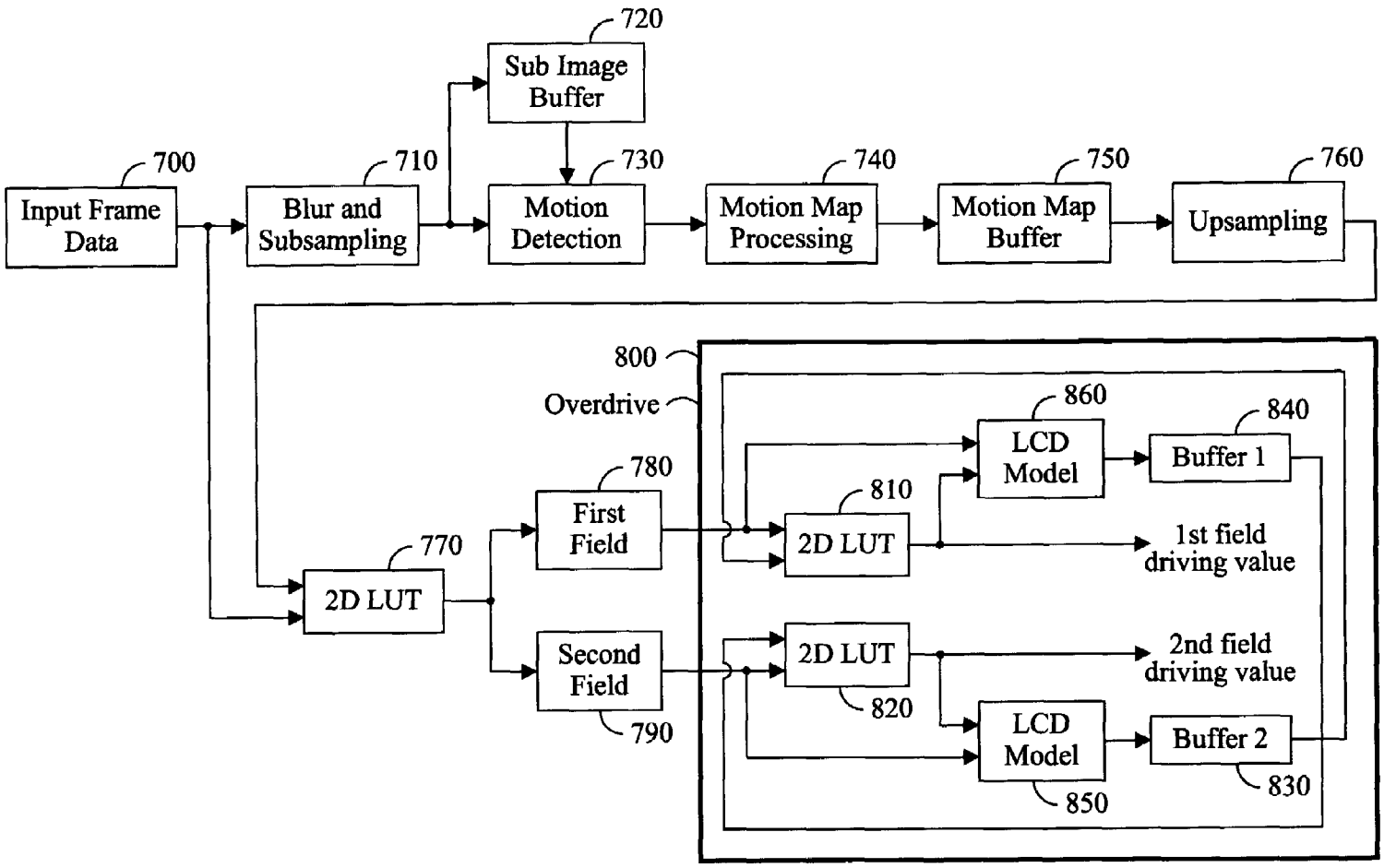
FIG. 9 illustrates motion adaptive black data insertion.
Figure 10A:
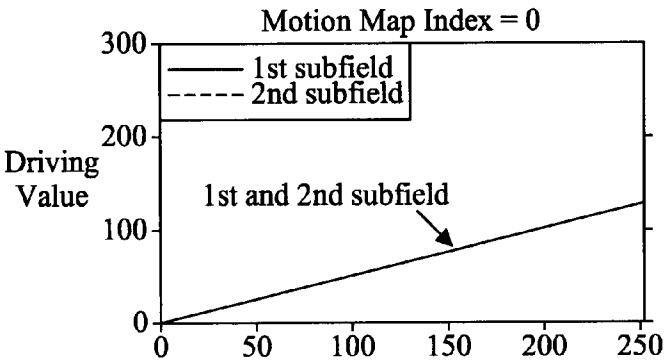
FIGS. 10A-10D illustrate look up tables for field driving values.
Figure 10B:
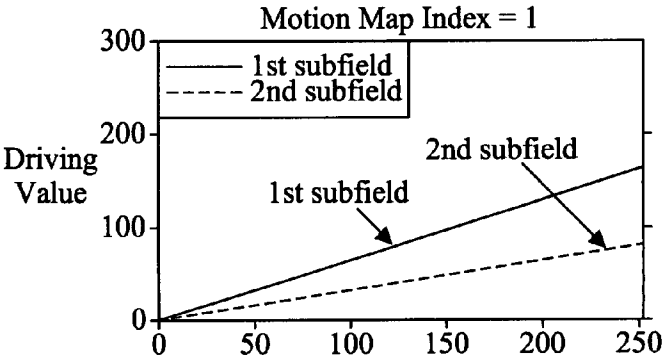
Figure 10C:
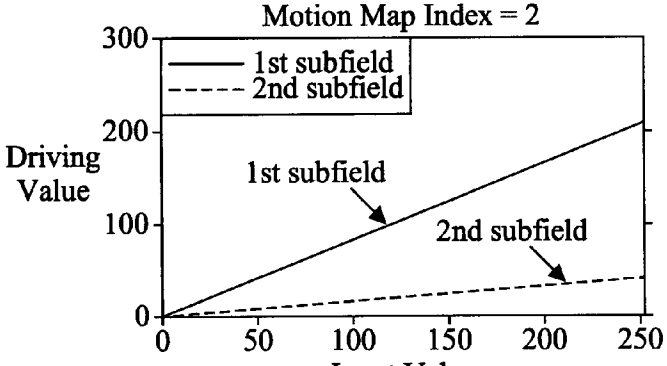
Figure 10D:
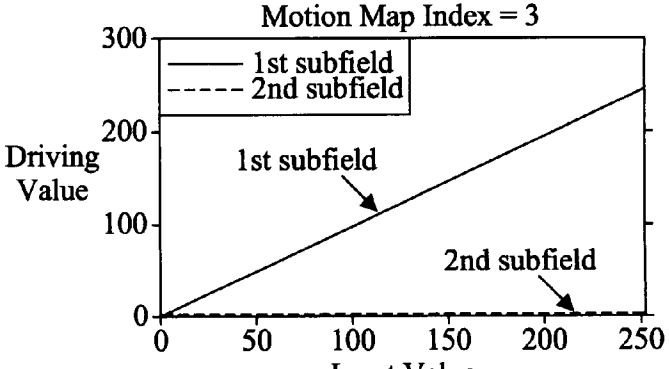

A typical implementation structure of the conventional overdrive (OD) technology is shown in FIG. 8. The implementation includes one frame buffer 400 and an overdrive module 402. The frame buffer stores previous target display value $x_{n-1}$ of driving cycle n-1. The overdrive module, taking current target display value $x_n$ and previous display value $x_{n-1}$ as input, derives the current driving value $z_n$ to make the actual display value $d_n$ the same as the target display value $x_n$.

In a LCD panel, the current display value $d_n$ is preferably not only determined by the current driving value $z_n$, but also by the previous display value $d_{n-1}$. Mathematically, $$d_n=f_d(z_n,d_{n-1}) \tag{1}$$

To make the display value $d_n$ reach the target value $x_n$, overdriving value $z_n$ should be derived from Equation (1) by making $d_n$ to be target value $x_n$. The overdriving value $z_n$ is determined in this example by two variables: the previous display value $d_{n-1}$ and the current driving values $x_n$, which can be expressed by the following function mathematically:

$$z_n=f_z(x_n,d_{n-1}) \tag{2}$$

Equation (2) shows that two types of variables: target values and display values, are used to derive current driving values. In many implementations, however, display values are not directly available. Instead, the described one-frame-buffer non-recursive overdrive structure assumes that every time the overdrive can drive the display value $d_n$ to the target value $x_n$. Therefore, Equation (2) can readily be simplified as $$z_n=f_z(x_n,x_{n-1}) \tag{3}$$

In Equation (3), only one type of variable: target values, is needed to derive current driving values, and this valuable is directly available without any calculation. As a result, Equation (3) is easier than Equation (2) to implement.

While black point insertion tends to reduce motion blur, it also tends to introduce flickering as an artifact. While the flickering artifact may be reduced by increasing the refresh rate, this is problematic for television based content (e.g., frame or field based content). For television based content, increasing the refresh rate may require motion compensated frame rate conversion which is computationally expensive and prone to additional artifacts.

After intensive study of the human perception of motion blur and flickering, it was determined that the flickering for a black data insertion technique tends to be more visible in a bright, low spatial frequency, non-motion area. In addition, the motion blur for a black data insertion technique tends to be primarily visible in a high spatial frequency, motion area. Based on these characterizations of the human visual system, a processing technique for the video should a motion adaptive technique to reduce motion blur without substantially increasing the flickering. Each frame in a video sequence is divided into multiple regions, and motion detection is performed for each corresponding region in the successive frames (or fields). Each region is classified as either a motion region or a non-motion region. The black data insertion is applied to the motion regions to reduce the motion blur, while black data insertion is not applied to the non-motion regions to reduce flickering. In addition, temporal transition frames may be used to smooth out intensity fluctuations between the black data insertions and the non-black data insertions.

FIG. 8 illustrates a technique for motion adaptive black data insertion. An input frame 700 of data is received. The input frame 700 is preferably blurred and sub-sampled to a lower resolution image 710 to reduce the computational complexity. Each pixel in the lower resolution image 710 corresponds to a region in the input frame 700. Each pixel in the lower resolution image 710 is compared to the previous frame stored in a sub-sampled image buffer 720 to detect motion 730. If the difference between the two pixels is greater than a threshold (such as 5% of the total range), then the pixel is classified as a motion pixel 740. This motion determination is performed on the remaining or selected pixels. Thus, each of the pixels may be characterized as motion, non-motion. The system may include multiple degrees of motion, if desired. A morphological dilation operation may be performed on the motion map 740 to group the non-motion pixels neighboring motion pixels to a motion pixel to form groups of motion pixels with similar motion characteristics. The dilation operation may be approximated with a low pass filter and a subsequent thresholding type operation. The resulting data from the dilation operation may be stored in a motion map buffer 750. Regions with no or limited motion are indicated by a 0 while regions with significant motion are indicated by a 3. There may be transitions between a region with limited motion and a region with significant motion, or vice versa. A change from insignificant motion to significant motion (or vice versa) the system may use a set of transition frames in order to avoid artifacts or other undesirable effects on the resulting image. During the transition, the motion map buffer 750 may indicate such a change in motion with other indicators, such as a region with "limited motion" indicated by a 1 (headed toward 0 or headed toward 2) and a region with "more motion" indicated by a 2 (headed toward 1 or headed toward 3). For example, a transition from no motion to significant motion may be done by a set of indicators of 1 for the frame, 2 for the next frame, and 3 for the subsequent frame (similar for the transition from significant motion to no motion). Other indications may likewise be used, as desired, to indicate additional transition frames and additional degrees of motion. It is to be understood that any type of determination may be used to determine those regions and/or pixels of the image that include sufficient or insufficient motion between one or more frames. The system may detect insufficient motion and sufficient motion, and thus use a set of one or more transition frames to change from one state to the other. In this case, the system does not necessarily need to quantify intermediate states of motion. The system, if desired, may determine intermediate levels of motion that is used together with or without transition frames. The sub-sampled image is stored in the sub-sampled image buffer 720 for subsequent frames. The image in the motion map buffer 750 may be up-sampled 760 to the size of the input image 700.

A look up table 770 is used to determine the field driving values (see FIG. 5) for the fields of the frame (typically two fields in a frame) based upon the up-sampled 760 motion map buffer 750 data. In general, it may be observed that the adaptive black data insertion technique uses a strong black data insertion for those regions of high motion and uses less or non-black data insertion for those regions of low motion. A pair (or more) look up tables may be used to derive the driving values for multiple fields in accordance with the estimated motion. Referring to FIG. 10 several input value versus driving value tables for the look up table 770 are illustrated for different frames and transition frames. In the exemplary technique, if the motion map value has a value of 0 then it indicates non-motion and thus a non-motion look up table (see FIG. 10A) is used. In the exemplary technique, if the motion map value has a value of 1 then it indicates the transition and a different look up table (see FIG. 10B) is used. In the exemplary technique, if the motion map value has a value of 2 then it indicates the transition and a different look up table (see FIG. 10C) is used. In the exemplary technique, if the motion map value has a value of 3 then it indicates significant-motion and thus a significant-motion look up table (see FIG. 10D) is used.

Figure 11:
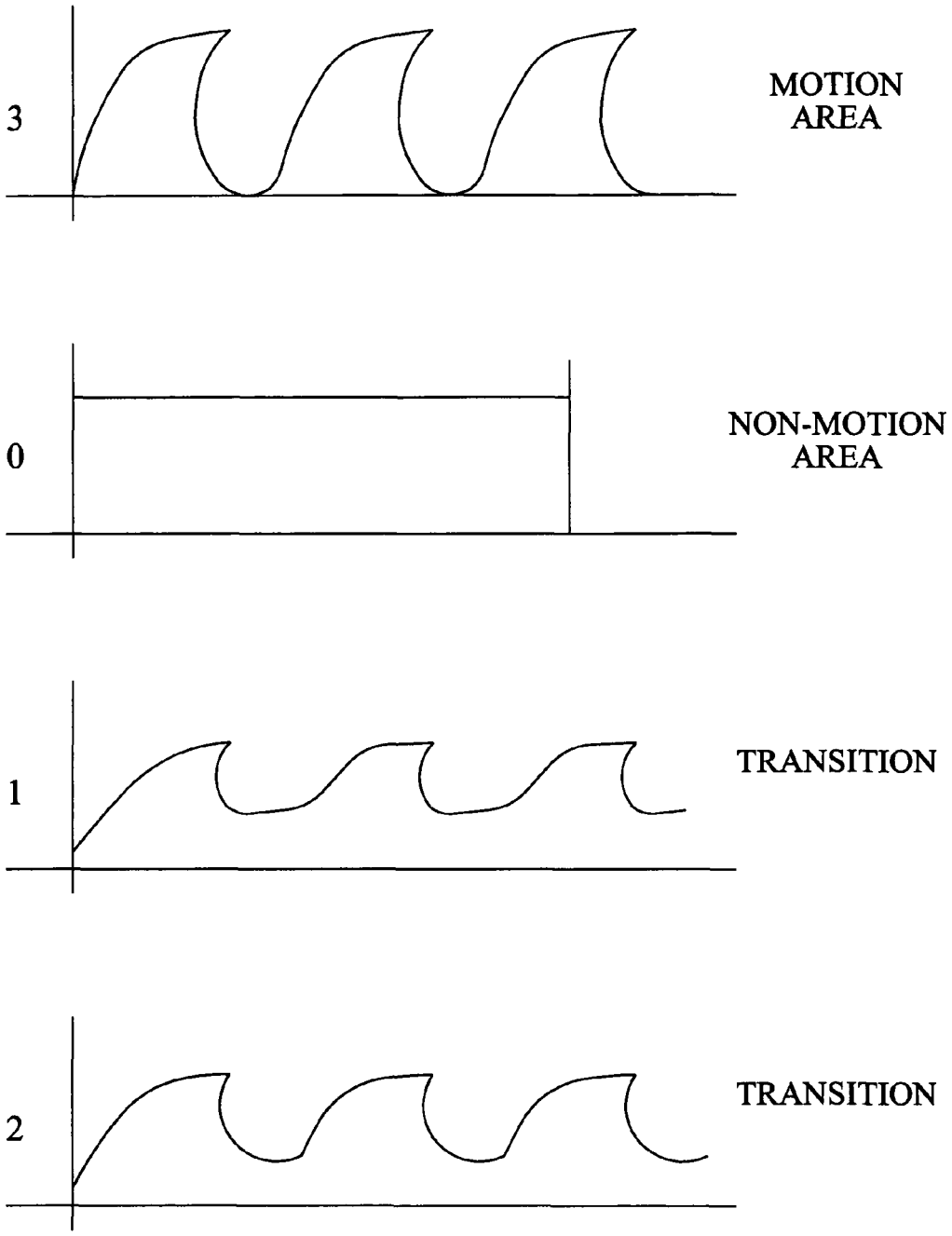
FIG. 11 illustrates the waveforms of FIG. 10

The respective look up tables are applied to the first field 780 and to the second field 790. The output of the first field 780 and second field 790 are provided to an overdrive 800. Any suitable overdrive technique may be used, as desired. The overdrive 800 includes a look up table 810 and 820 for respective first field 780 and second field 790. The output of the look up table 810 for the first field 780 is based upon the output of the previous field from buffer 2 830 (second field of the previous frame). The output of the look up table 820 for the second field 790 is based upon the output of the previous field from buffer 1 840 (first field of the same frame). The state of the previous frame for the first field 780 (input from buffer 2 830) is determined based upon a model of the liquid crystal display 850, the second field 790 of the previous frame, and the output of the look up table 820. The state of the previous frame for the second field 790 (input from buffer 1 840) is determined based upon a model of the liquid crystal display 860, the first field 780 of the previous field, and the output of the look up table 810. Accordingly, the previous field may be used in the overdrive scheme. FIG. 11 illustrates the general resulting waveforms for the driving scheme shown in FIG. 10.

A similar technique may likewise be applied for the overdrive system based upon the spatial frequency of regions of the image, such as low and high spatial frequencies. In addition, a similar technique may be applied for the overdrive system based upon the brightness of regions of the image, such as low brightness and high brightness. These likewise may be applied in combination or based upon one another (e.g., spatial, brightness, and/or motion). The adaptive technique may be accommodated by applying the spatial modifications to the LCD layer of the display. Also, the transition frames may be accommodated by applying the spatial modifications to the backlight, such as a LED array. Moreover, the technique may be accommodated by a combination of the LCD layer and the backlight layer.

Liquid crystal displays have limited dynamic range due the extinction ratio of polarizers and imperfection of the liquid crystal material. In order to display high dynamic images, a low resolution light emitting diode (LED) backlight system may be used to modulate the light that feeds into the liquid crystal material. By the combination of LED and LCD, a very high dynamic range display can be achieved. For cost reasons, the LED typically has lower spatial resolution than the LCD. Due to the lower resolution LED, the high dynamic range display based on this technology can not display a high dynamic pattern of high spatial resolution. But it can display both very bright image (>2000 cd/m$^2$) and very dark image (<0.5 cd/m$^2$) simultaneously. The inability to display high dynamic range of high spatial resolution is not a serious issue since the human eye has limited dynamic range in a local area, and with visual masking, the human eye can hardly perceive the limited dynamic range of high spatial frequency content.

Figure 12:
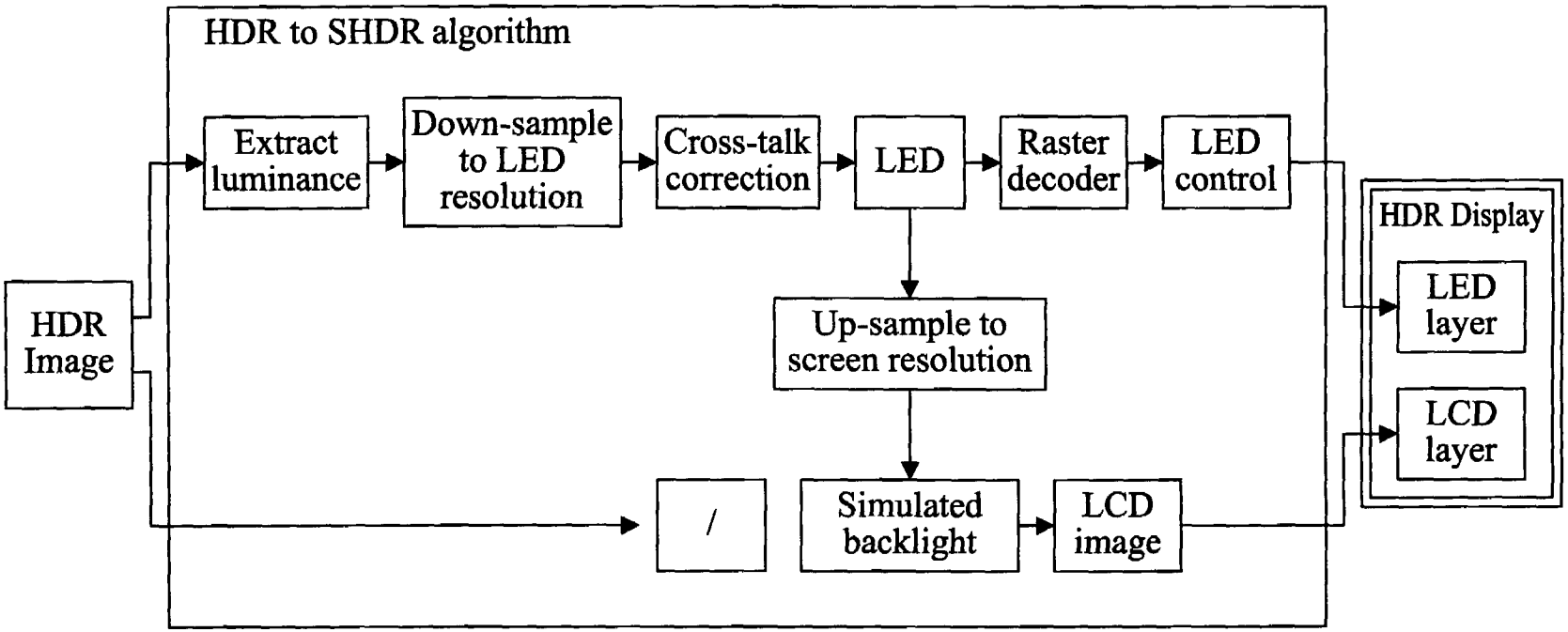
FIG. 12 illustrates an image processing technique.

FIG. 12 illustrates one previously existing technique to convert a high spatial resolution high dynamic range (HDR) image into a lower resolution light emitting diode (LED) image and a high resolution liquid crystal display image. The luminance is extracted from the HDR image. The extracted luminance is then low pass filtered and sub-sampled to the resolution of the LED array. The filtered and sub-sampled image may be processed to reduce cross talk effects. The cross-talk corrected image may be sent to a raster decoder and displayed on the LED layer of the HDR display.

The desirable backlight image may be predicted by convolving an up-sampled LED image with the point spread function of LED. The LCD image is derived by dividing the original HDR image with predicted backlight image to obtain the simulated backlight. Since the final displayed image is the product of LED backlight image and the LCD transmittance, this approach reproduces the original HDR image. Unfortunately, the resulting displayed images using this technique tends to have limited bright specular highlights that are limited in spatial extent. Accordingly, many HDR images contains specular highlight that are extremely bright, but very small in spatial extent, which may not be adequately represented on the display.

It was determined that the low pass filtering process smears this specular highlight causing the corresponding LED to have a lower value. Traditionally it would have been thought that any of the spatial details lost in the low pass filtering process could be recovered in the division operation. Although any spatial details lost in the filtering step can be theoretically recovered in the LCD image via the division operation, it turns out that the LCD can not recover the bright specular highlight due to its limited range (its transmittance can not exceed 1). Thus specular highlights are lost in the final display image although the HDR is capable of displaying that bright highlight.

It was also determined that the low pass filtering works well for regions of the image that are not at the extremes of brightness and darkness. Accordingly, another criteria may be used to account for those regions where the low pass filtering is not exceptionally effective. In addition to using the low pass filtered image to derive the LED image, the system may also use the maximum image (or some value associated with regions where a significant value exists) which is the local maximum in the HDR image divided by the max transmittance of LCD. The final LED image is selected to be the larger of the low pass filtered image and the maximum image.

In addition, it was determined that the broad spread in the LED point spread function (PSF), results in decreasing the potential contrast ratio of the image and also fails to minimize the power consumption of the display. In order to improve the contrast ratio an iterative approach may be used to derive the LED driving value to achieve a higher contrast in the backlight image. The resulting higher contrast backlight image combining with the high resolution LCD image can produce much higher dynamic image to be displayed and also reduce the power consumption of the LED backlight.

Upon yet further investigation, moving images tend to flicker more than expected, i.e. the fluctuation of display output. After consideration of a particular configuration of the display, namely a LCD combined with LED array, it was determined that the temporal response of the LCD layer is different than the LED array in a manner that may result in flickering. In general, the LED has a much faster temporal response than the LCD layer. In addition, these errors resulting in flickering may be due to inaccuracies in the point spread function approximation, which may vary from display to display, and from led to led. In addition, the course nature of the LED array tends to result in course selection of the LED values, generally being on or off. To decrease the flickering on the display a temporal low-pass filter may be used and a finner control over the values selected for proximate LEDs. In addition, gamma correction may be used to account for the quantization error that is inherent to LED driving circuit.

FIG. 1 shows a schematic of a HDR display with LED layer as a backlight for a LCD. The light from array of LEDs passes through the diffusion layer and illuminates the LCD. The backlight image is given by:

$$bl(x,y)=\mathrm{LED}(i,j)*\mathrm{psf}(x,y) \tag{4}$$

where LED(i,j) is the LED output level of each LED, and psf(x,y) is the point spread function of the diffusion layer. * denotes convolution operation. The backlight image is further modulated by the LCD.

The displayed image is the product of LED backlight and transmittance of LCD: $T_{LCD}(x,y)$.

$$\mathrm{img}(x,y)=bl(x,y)T_{LCD}(x,y)=(\mathrm{led}(i,j)*\mathrm{psf}(x,y))T_{LCD}(x,y) \tag{5}$$

By combining the LED and LCD, the dynamic range of display is the product of the dynamic range of LED and LCD. For simplicity, the notation may use normalized LCD and LED output limited to between 0 and 1.

Figure 13:
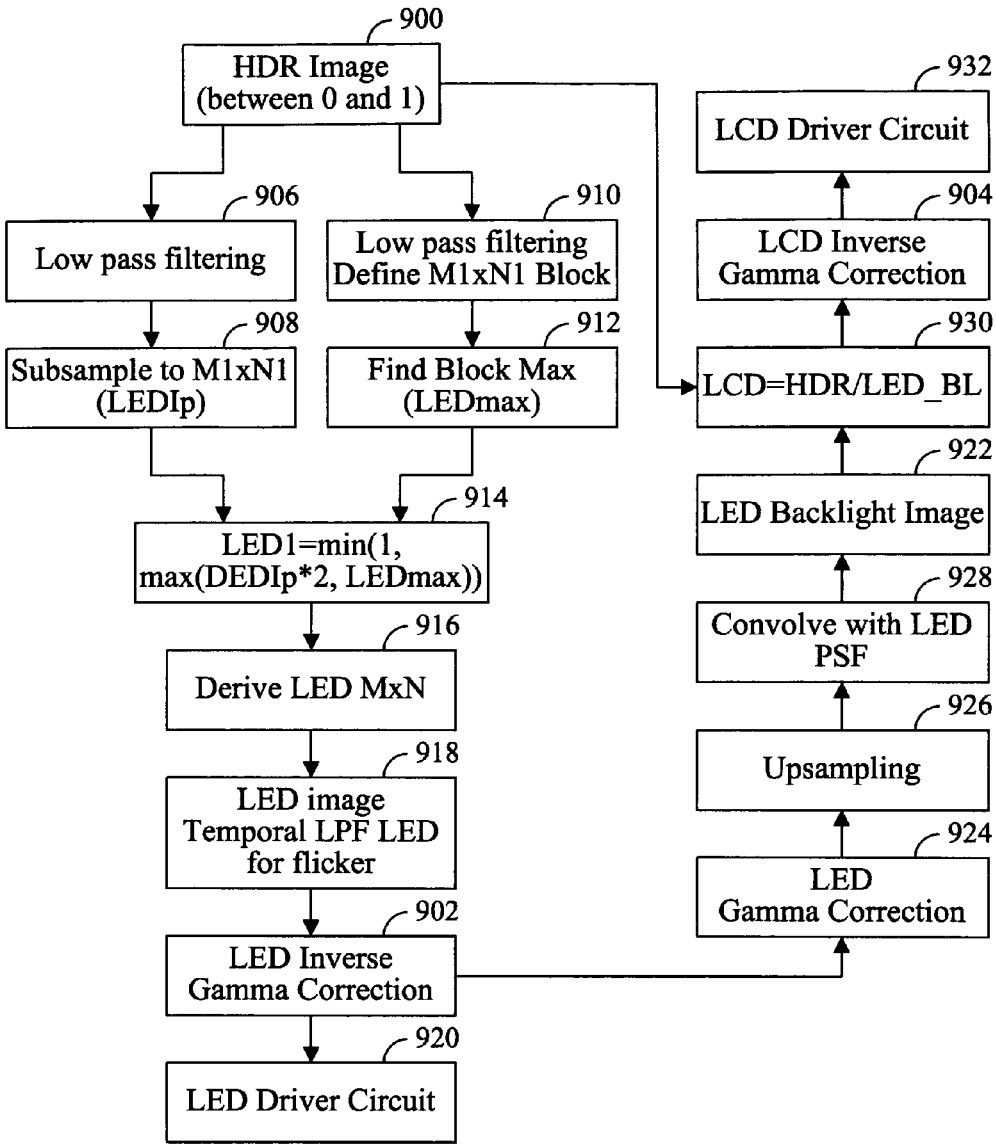
FIG. 13 illustrates deriving LED and LCD driving values.

FIG. 13 shows an exemplary technique to convert a HDR image 900 into a low resolution LED image 902 and a high resolution LCD image 904. The LCD resolution is m×n pixels with its range from 0 to 1, with 0 to be black and 1 to be the maximum transmittance. The LED resolution is M×N with M<m and N<n. For simplicity it may be assumed that the HDR image has the same resolution as LCD. If HDR image is of different resolution, a scaling or cropping step may be used to convert the HDR image to LCD image resolution.

The HDR image is low pass filtered 906 by the point spread function of the diffusion screen (or other function) and sub-sampled 908 (down sample) to an intermediate resolution (M1×N1). One example of an intermediate resolution is twice the LED resolution (2M×2N). The extra resolution of the sub-sampled image is used to reduce flickering that would occur as a result of moving objects over a series of frames of a video. The additional data points in the LED matrix permit a smoothing of the transition of the LED values when movement occurs in the image of a video. This facilitates one LED to gradually decrease in value as an adjacent LED gradually increases in value, which reduces the resulting flickering of the image that would result if the changes were more abrupt.

The same HDR image 900 is again low-pass filtered 910 by a small filter kernel, such as 5×5 to simulate the anticipated size of the specular pattern. The low-pass filtered image 910 is divided into M1×N1 blocks, each block corresponding to the intermediate resolution with some overlap between each block, i.e., the block size is (1+k)*(m/M×n/N), where k is the overlapping factor. For each block, the block maximum (or other suitable value) is used to form a LEDmax image (M×N) 912. k=0.25 is used is preferably used. It is to be understood that any suitable technique may be used to define the maximum for each pixel location based upon the pixel location, region, and/or neighboring regions.

From these two LED images, the larger of 2*LED1*p* and LEDmax, i.e. LED1=min(max(LED1*p2,LEDmax),1) is selected 914. This larger value helps account for the fact that the low pass filtering tends to decrease the dynamic range that would otherwise have been rendered on the display. The min operation is used to constrain the LED value from 0 to 1. In addition, taking into account the local maximum assists to preserve the specular highlight. Also in the non specular highlight area; the system may set the LED 1 to less than twice of the LED1***p* to ensure operation toward the maximum LCD operating range. An increase in the LCD operating range results in a decrease in the needed backlight light, and thus a reduces the power requirements. This technique can better accommodate areas with both high dynamic range and high spatial frequency.

Figure 14:
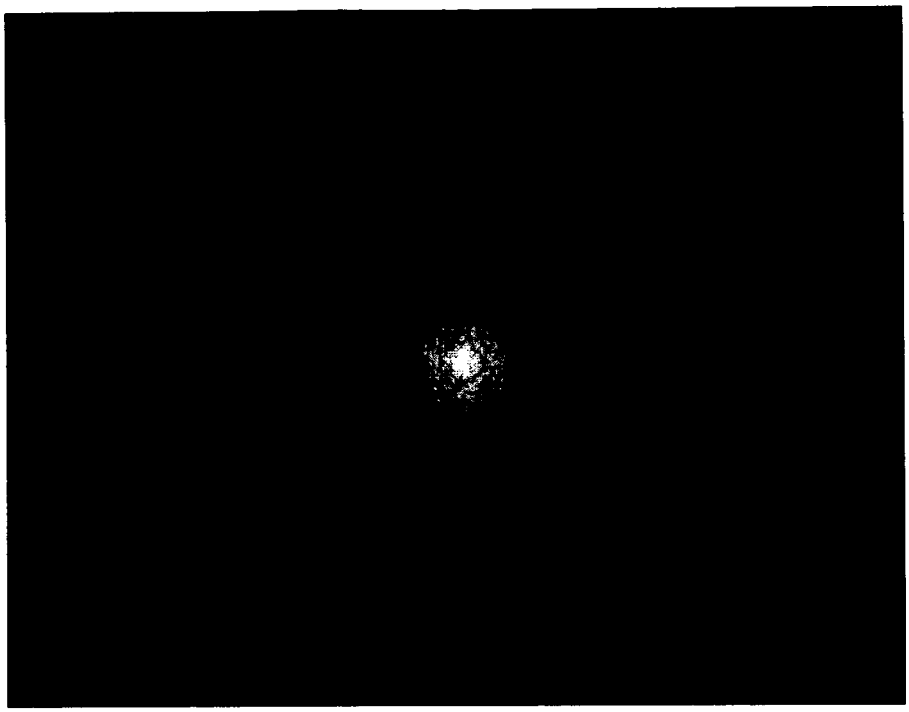
FIG. 14 illustrates LED PSF.

The LED1 is of size M1×N1 and range from 0 to 1. Since the PSF of diffusion screen is typically larger than the LED spacing to provide a more uniform backlight image, there is tends to be considerable crosstalk between the LED elements that are located close together. FIG. 14 shows a typical LED PSF with the black lines indicating the borders between LEDs. It is apparent that the PSF extends beyond the boarder of a particular LED.

Because of the PSF of diffusion screen, any LED has contribution from its entire neighboring LEDs. Although Equation 5 can be used to calculate the backlight if given a LED driving signal, deriving LED driving signal to achieve a target backlight image is an inverse problem. This problem results in an ill posed de-convolution problem. Traditionally, a convolution kernel used to derive the LED driving signal as shown in Equation 6. The crosstalk correction kernel coefficients ($c_1$ and $c_2$) are negative to compensate for the crosstalk from neighboring LEDs.

$$\text{crosstalk} = \begin{vmatrix} c_2 & c_1 & c_2 \\ c_1 & c_0 & c_1 \\ c_2 & c_1 & c_2 \end{vmatrix} \tag{6}$$

The crosstalk correction matrix does reduce the crosstalk effect from its immediate neighbors, but the resulting backlight image is still inaccurate with a low contrast. Another problem is that it produces many out of range driving values that have to be truncated which can result in more errors.

Since the LCD output can not be more than 1, the led driving value is derived so that backlight is larger than target luminance, i.e.

$$\text{led}(i,j):\{\text{led}(i,j)*\text{psf}(x,y)\geq I(x,y)\} \tag{7}$$

The syntax uses ":" to denote the constraint to achieve the desired LED values of the function in the curly bracket. Because of the limited contrast ratio (CR) due to leakage, LCD(x,y) generally can no longer reach 0. The solution is that when target value is smaller than LCD leakage, the led value is reduced to reproduce the dark luminance.

$$\text{led}(i,j):\{\text{led}(i,j)\otimes\text{psf}(x,y)<I(x,y)\cdot\text{CR}\} \tag{8}$$

Another feature is power saving so that the total LED output should be minimized or otherwise reduced.

$$led(i,\ j):\left\{\min\sum_{i,j} led(i,\ j)\right\} \tag{9}$$

Flickering is due, at least in part, to the non-stationary response of the LED which combines with the mismatch between the LCD and LED. The mismatch can be either spatially or temporally. Flickering can be reduced by decreasing the total led output fluctuation as a point object move through the LED grid.

$$led(i,\ j):\left\{\min\left(\sum_{i,j} led(i,\ j)-\sum_{i,j} led(i-x_0,\ j-y_0)\right)\right\} \tag{10}$$

where $x_0$ and $y_0$ is the distance from the center of the LED. The flickering can be further reduced by temporal IIR filtering. Combining Equation 7 to 10, yields equation 11 below.

$$led(i,\ j):\left\{\begin{array}{l} led(i,\ j)*psf(x,\ y)\geq I(x,\ y) \\ led(i,\ j)*psf(x,\ y)<I(x,\ y)\cdot CR \\ \min\sum_{i,j} led(i,\ j) \\ \min\left(\sum_{i,j} led(i,\ j)-\sum_{i,j} led(i-x_0,\ j-y_0)\right) \end{array}\right\} \tag{11}$$

Figure 15:
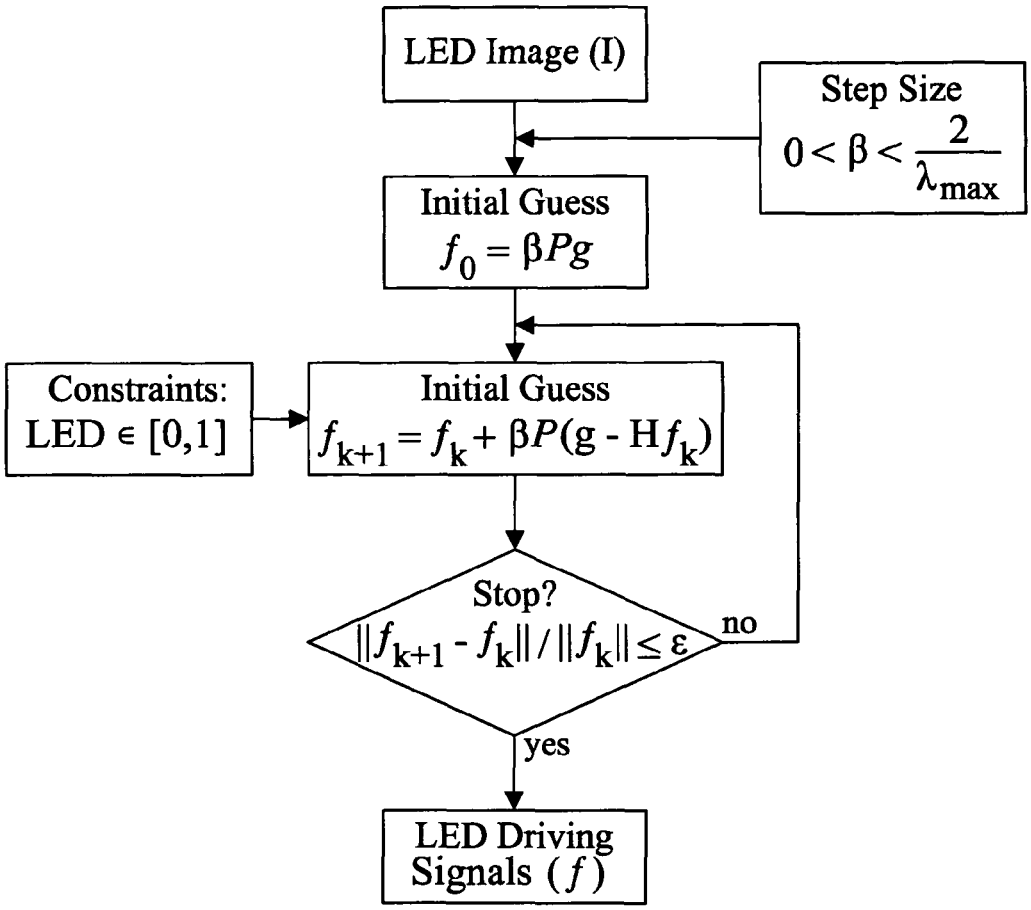
FIG. 15 illustrates another technique to derive LED signals.

FIG. 15 shows a technique to derive a LED value 916 using a constrained optimization process. The target LED image I (M1×N1) is first converted to a column vector of size MN2=M1*N1. Equation 4 can be converted to matrix form:

$$\begin{bmatrix} I_1 \\ I_2 \\ I_3 \\ \vdots \\ I_{MN2} \end{bmatrix} = \begin{bmatrix} psf_{1,1} & psf_{1,2} & psf_{1,3} & \cdots & psf_{1,MN} \\ psf_{2,1} & psf_{2,2} & psf_{2,3} & \cdots & psf_{2,MN} \\ psf_{3,1} & psf_{3,2} & psf_{3,3} & \cdots & psf_{3,MN} \\ \vdots & \vdots & \vdots & & \vdots \\ psf_{MN2,1} & psf_{MN2,2} & psf_{MN2,2} & \cdots & psf_{MN2,MN} \end{bmatrix} \begin{bmatrix} LED_1 \\ LED_2 \\ LED_3 \\ \vdots \\ LED_{MN} \end{bmatrix} \tag{12}$$

where LED is the driving values in a vector format. MN is the total number of LEDs which is equal to M*N. The backlight is the matrix multiplication of LED vector with the crosstalk matrix of size MN×MN2, where MN2>=MN. The crosstalk matrix $psf_{i,j}$ is the crosstalk coefficients from the ith LED to the jth backlight position, which can be derived from the measured PSF function.

The technique to derive the LED image 918 starts with initial guess of βPg; and then derives each successive LED driving value based on the formula $f_{k+1}=f_k+\beta P(g-Hf_k)$, where H is the crosstalk matrix as shown in equation 12. g is the target LED in vector format and P is a masking matrix of size MN by MN2 with 1 at LED locations and 0 at other locations. Since the LED driving value is limited to between 0 and 1, it is truncated to between 0 and 1. The newly derived LED value is compared to the previous one to calculate the change rate. If the change rate is greater than a threshold, the process is repeated until the change rate is less than the threshold or exceeding the maximum iteration.

Figure 16:
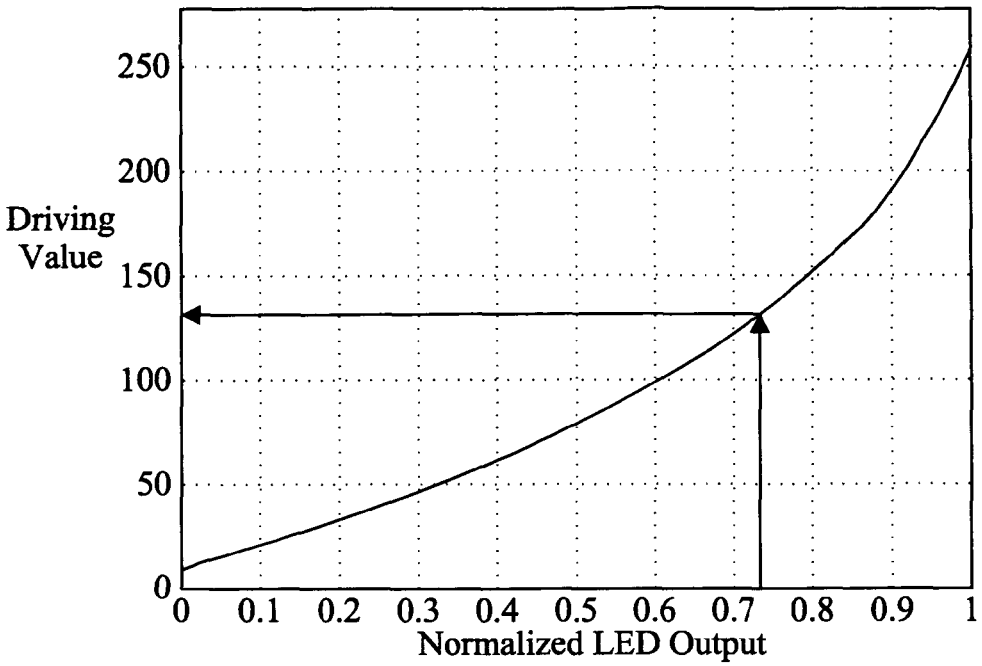
FIG. 16 illustrates LED inverse gamma correction.

Since the LED output is non-linear with respect to the driving value and it driving value is integer, inverse gamma correction and quantization are performed to determine the LED driving value. FIG. 16 shows the process of inverse gamma correction 902 for the LED. The quantized driving value is again gamma corrected; this is the actual LED output to the LED driver circuit 920.

The next step is to predict the backlight image 922 from the LED. The LED image 902 is gamma corrected 924, up-sampled to the LCD resolution (m×n) 926, and convolved with the PSF of the diffusion screen 928.

The LCD transmittance 930 may be given by:

$$T_{LCD}(x,y)=\mathrm{img}(x,y)/bl(x,y)$$

Figure 17:
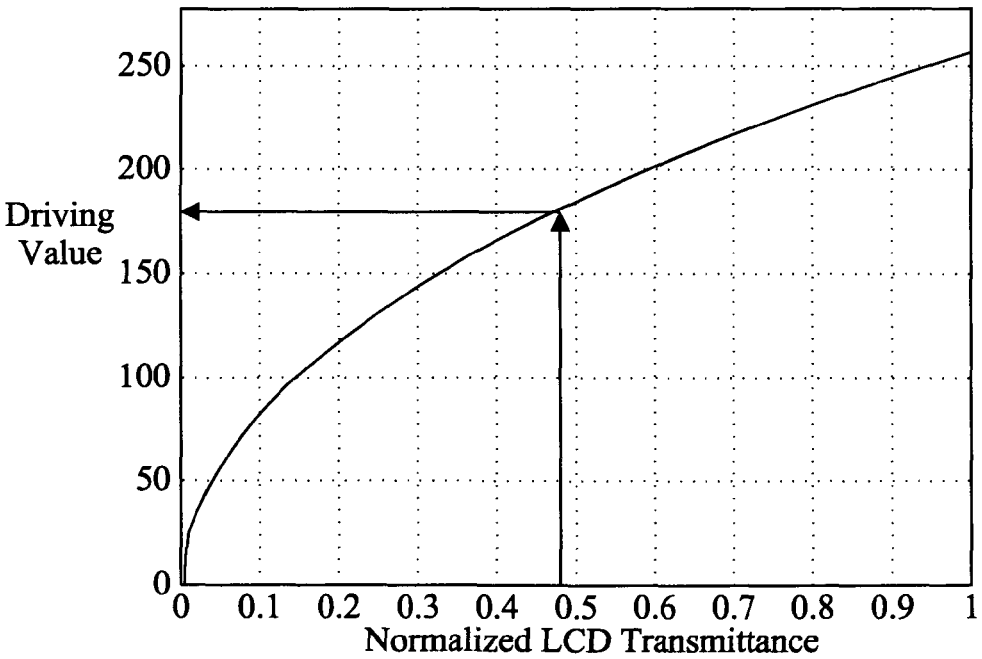
FIG. 17 illustrates LCD inverse gamma correction.

Again, inverse gamma correction is performed as in FIG. 17 to correct the nonlinear response of the LCD and provided to the LCD driver circuit 932.

To reduce the flickering effect, a temporal low pass filter 918 is used to smooth sudden temporal fluctuations.

$$led_n(i,j)=\begin{cases} k_{up}f(i,j)+(1-k_{up})led_{n-1}(i,j) & f(i,j)>led_{n-1}(i,j) \\ k_{down}f(i,j)+(1-k_{down})led_{n-1}(i,j) & \text{else} \end{cases} \quad (11)$$

where $k_{up}$ is chosen to be higher than $k_{down}$ to satisfy Equation 7. Typically $k_{up}$=0.5, and $k_{down}$=0.25. Thus, the LED backlight is constrained over multiple frames to change from one value to another in one or more increments. For example, the backlight may change from 0 to 200, and thus be 0 in a first frame, 100 in the second frame, and 200 in the third frame. The LED is preferably permitted to go up at a faster rate than it is permitted to go down.

All the references cited herein are incorporated by reference.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A method for displaying an image on a liquid crystal display including a light valve and a backlight array of individually controllable lighting elements, where said display has a leakage value representing the intensity of light that passes through closed liquid crystal elements of said display, said method comprising:

(a) receiving an image;

(b) modifying said image to provide data to said light valve;

(c) modifying said image to provide data to said backlight array;

(d) wherein said data provided to said backlight array is based upon maintaining the following constraints:

(i) the lighting element value is greater than a corresponding pixel value;

(ii) the lighting element is decreased in value when less than the leakage value of the display; and (e) wherein said data to said backlight array is determined by a sequence of iteratively calculated values based on a crosstalk constraint, and such that:

(i) the difference between each successive pair of iterated values is calculated; and (ii) iteration ends when the calculated said difference between a successive pair of iterated values is less than a threshold.

2. The method of claim 1 wherein said constraints impose that the light valve has a transmission no greater than unity.

3. The method of claim 1 wherein said leakage value is determined based upon the image data and the contrast ratio of the display.

4. The method of claim 1 wherein said lighting elements are decreased based upon a power savings criteria.

5. A method for displaying an image on a liquid crystal display including a light valve and a backlight array of individually controllable lighting elements comprising:

(a) receiving an image;

(b) modifying said image to provide data to said light valve;

(c) modifying said image to provide data to said backlight array;

(d) wherein said data provided to said backlight array is based upon maintaining the following constraint:

(i) the lighting element value is based upon the substantial maximum of the image data for the corresponding portion of the image;

(e) wherein said data provided to said light value corresponding to said lighting element is suitable to provide the desired illumination for said image; and (f) wherein said data to said backlight array is determined by a sequence of iteratively calculated values based on a crosstalk constraint, and such that:

(i) the difference between each successive pair of iterated values is calculated; and (ii) iteration ends when the calculated said difference between a successive pair of iterated values is less than a threshold.

6. The method of claim 5 where said display has a leakage value representing the intensity of light that passes through closed liquid crystal elements of said display, and wherein said data provided to said backlight is based upon maintaining the following constraints:

(i) the lighting element value is greater than the corresponding pixel value;

(ii) the lighting element is decreased in value when less than the leakage value of the display.

7. The method of claim 5 wherein said lighting element is further based upon a low pass filtered image data for the corresponding portion of the image.

8. The method of claim 7 wherein said lighting element is based upon a selection between said lower pass filtered image data and said substantial maximum.

9. A method for displaying an image on a liquid crystal display including a light valve and a backlight array of individually controllable lighting elements comprising:

(a) receiving an image;

(b) modifying said image to provide data to said light valve;

(c) modifying said image to provide data to said backlight array;

(d) wherein said data provided to said backlight array is determined by a sequence of iteratively calculated values based on a crosstalk constraint, and such that:

(i) the difference between each successive pair of iterated values is calculated; and (ii) iteration ends when the calculated said difference between a successive pair of iterated values is less than a threshold.

10. The method of claim 9 where said display has a leakage value representing the intensity of light that passes through closed liquid crystal elements of said display, and wherein said data provided to said backlight array is based upon maintaining the following constraints:

(i) the lighting element value is greater than the corresponding pixel value;

(ii) the lighting element is decreased in value when less than the leakage value of the display.

11. A method for displaying an image on a liquid crystal display including a light valve and a backlight array of individually controllable lighting elements comprising:

(a) receiving an image;

(b) modifying said image to provide data to said light valve;

(c) modifying said image to provide data to said backlight array;

(d) wherein said data provided to said backlight array is based upon a temporal filter and determined by a sequence of iteratively calculated values based on a crosstalk constraint, and such that: (i) the difference between each successive pair of iterated values is calculated; and (ii) iteration ends when the calculated said difference between a successive pair of iterated values is less than a threshold.

12. The method of claim 11 wherein said temporal filter is low-pass.

13. The method of claim 11 wherein said data provided to said backlight array is based upon maintaining the following constraints:

(i) the lighting element value is greater than the corresponding pixel value;

(ii) the lighting element is decreased in value when less than the leakage value of the display;

(iii) the lighting elements are decreased in value while the corresponding light value is increased in transmission.

14. A method for displaying an image on a liquid crystal display including a light valve and a backlight array of individually controllable lighting elements comprising:

(a) receiving an image;

(b) modifying said image to provide data to said light valve;

(c) modifying said image to provide data to said backlight array;

(d) wherein said data provided to said backlight array is determined by a sequence of iteratively calculated values based on a crosstalk constraint, and such that:

(i) the difference between each successive pair of iterated values is calculated; and (ii) iteration ends when the calculated said difference between a successive pair of iterated values is less than a threshold, said calculated pair of iterated values based upon a data structure denser than the individual backlight array elements.

15. The method of claim 14 wherein said data structure has twice the density of said backlight array elements.

16. The method of claim 14 where said display has a leakage value representing the intensity of light that passes through closed liquid crystal elements of said display, and wherein said data provided to said backlight array is based upon maintaining the following constraints:

(i) the lighting element value is greater than the corresponding pixel value;

(ii) the lighting element is decreased in value when less than the leakage value of the display.

* * * * *